US010350915B2

(12) United States Patent
Shomura et al.

(10) Patent No.: US 10,350,915 B2
(45) Date of Patent: Jul. 16, 2019

(54) RECORDING APPARATUS

(71) Applicant: SEIKO EPSON CORPORATION, Tokyo (JP)

(72) Inventors: Hikari Shomura, Inzai (JP); Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/991,187

(22) Filed: May 29, 2018

(65) Prior Publication Data

US 2018/0345688 A1 Dec. 6, 2018

(30) Foreign Application Priority Data

May 31, 2017 (JP) ..... 2017-108311

(51) Int. Cl.

| | |
|---|---|
| ***B41J 11/057*** | (2006.01) |
| ***B41J 11/00*** | (2006.01) |
| ***B41J 11/06*** | (2006.01) |
| ***B41J 13/02*** | (2006.01) |
| ***B65H 29/12*** | (2006.01) |
| ***B65H 29/70*** | (2006.01) |
| ***B65H 5/06*** | (2006.01) |
| ***B65H 5/38*** | (2006.01) |
| ***B41J 2/15*** | (2006.01) |
| ***B41J 25/308*** | (2006.01) |

(52) U.S. Cl.

CPC ..... *B41J 11/057* (2013.01); *B41J 2/15* (2013.01); *B41J 11/0005* (2013.01); *B41J 11/0045* (2013.01); *B41J 11/06* (2013.01); *B41J 13/02* (2013.01); *B41J 25/308* (2013.01); *B65H 5/062* (2013.01); *B65H 5/068* (2013.01); *B65H 5/38* (2013.01); *B65H 29/125* (2013.01); *B65H 29/70* (2013.01); *B65H 2301/5122* (2013.01); *B65H 2801/15* (2013.01)

(58) Field of Classification Search

CPC ..... B41J 11/58; B41J 3/4071; B41J 13/0054; B41J 13/103; B41J 13/106; B41J 13/12; B41J 13/24; B41J 15/00; B41J 15/04; B41J 15/18; B41J 17/02; B41J 17/20; B41J 17/18; B41J 11/057; B41J 2/15; B41J 11/006; B41J 11/0065; B41J 11/007

See application file for complete search history.

(56) References Cited

U.S. PATENT DOCUMENTS

| | | | | |
|---|---|---|---|---|
| 2005/0024463 | A1 | 2/2005 | Kida | |
| 2008/0180508 | A1* | 7/2008 | Ota | B41J 11/057 347/104 |
| 2009/0109250 | A1* | 4/2009 | Johnston | B41J 11/057 347/4 |

(Continued)

FOREIGN PATENT DOCUMENTS

| | | | |
|---|---|---|---|
| EP | 1053883 | A2 | 11/2000 |
| JP | 2000-071532 | A | 3/2000 |

OTHER PUBLICATIONS

European Search Report issued in Application No. 18173411 dated Oct. 12, 2018.

*Primary Examiner* — Kristal Feggins
(74) *Attorney, Agent, or Firm* — Workman Nydegger

(57) ABSTRACT

Convex portions formed on a sheet of paper by a forming section are maintained in a favorable condition and good recording quality is obtained.

13 Claims, 18 Drawing Sheets

(56) References Cited

U.S. PATENT DOCUMENTS

| | | | | |
|---|---|---|---|---|
| 2013/0240593 | A1* | 9/2013 | Maeyama | B65H 20/00<br>226/181 |
| 2015/0029263 | A1 | 1/2015 | Arakane | |
| 2016/0288493 | A1 | 10/2016 | Arakane | |

* cited by examiner

RECORDING APPARATUS

BACKGROUND

1. Technical Field

The present disclosure relates to a recording apparatus that performs recording on a medium.

2. Related Art

A recording apparatus, a typical example of which is an ink jet printer, includes a medium-support platform (otherwise called a "platen") at a position opposing a recording unit that performs recording on a sheet of paper, in other words, a medium. The medium-support platform supports a sheet of paper and defines the distance between the sheet and the recording unit (the distance may be called a "platen gap").

Such a recording apparatus may be formed so as to form a corrugation (otherwise called "cockling"), which is a pattern of waves of which the direction intersects the medium transport direction. To restrain the sheet from flapping on the medium-support platform, the corrugation is formed on a sheet before the recording unit performs recording. For example, JP-A-2000-71532 discloses a recording apparatus that includes ribs 13 and recesses 15 provided under a recording head 1 (recording unit) and on the upper surface of a platen 11 (medium-support platform) that guides the back side of a recording sheet S. The ribs 13 and the recesses 15 serve as a wave-pattern-forming section that forms a pattern of waves in the sheet width direction of the recording sheet S. The corrugation formed on a sheet makes the sheet tougher and more rigid and thereby ensures consistent orientation of the sheet on the platen 11. As a result, favorable recording quality is obtained in recording performed by the recording head 1. Moreover, disturbance of recorded results due to the sheet touching the recording unit can be prevented.

Here, in JP-A-2000-71532, the wave-pattern-forming section (the ribs 13 and the recesses 15) is disposed immediately downstream of a transport roller pair (a resist roller pair 10) that transports a sheet toward the recording unit (recording head 1). When a wave pattern is formed on a sheet immediately downstream of the transport roller pair, the sheet tends to return to its original shape from a state of the sheet having the wave pattern because of tension generated in the sheet due to the transport roller pair nipping the sheet. Accordingly, a region in which the wave pattern can be formed on the sheet tends to be narrow in the medium transport direction. This may make it difficult to have the recording unit extend in the medium transport direction when, for example, upgrading the recording unit so as to perform higher resolution recording.

SUMMARY

An advantage of some aspects of the disclosure is that a recording apparatus that maintains, in good condition, a wave pattern formed in a wave-pattern-forming section and thereby provides better recording quality is provided.

A recording apparatus according to an aspect of the disclosure includes a recording section that performs recording by ejecting liquid onto a medium being transported, an upstream-side transport section that is disposed upstream of the recording section in a medium transport direction, a downstream-side transport section that is disposed downstream of the recording section in the medium transport direction, and a forming section that is disposed upstream of the upstream-side transport section in the medium transport direction and that forms first convex portions protruding from one side of the medium and extending in the medium transport direction and second convex portions protruding from the other side of the medium and extending in the medium transport direction. In addition, the first convex portions and the second convex portions are formed alternately on the medium in a width direction that intersects the medium transport direction. In the recording apparatus, the upstream-side transport section includes transport roller pairs that are disposed in the width direction and that nip and transport the medium, and the transport roller pairs nip either the first convex portions or the second convex portions that are formed on the medium.

According to this configuration, the upstream-side transport section includes transport roller pairs disposed upstream of the recording section in the medium transport direction, and the transport roller pairs that nip and transport the medium are arranged in the width direction. In addition, the transport roller pairs nip either the first convex portions or the second convex portions. As a result, the upstream-side transport section is prevented from acting so as to remove the wave pattern (convex portions) formed by the forming section. In other words, the medium can be transported while the wave pattern formed by the forming section is maintained in a favorable condition, which leads to good recording quality. Moreover, the forming section is disposed upstream of the upstream-side transport section in the medium transport direction. Accordingly, the medium on which the wave pattern is formed by the forming section can be reliably sent to the upstream-side transport section, and readily transported by the upstream-side transport section with the wave pattern being maintained.

It is preferable that in the recording apparatus, the transport roller pairs nip the first convex portions formed on the medium. According to this configuration, the transport roller pairs nip the first convex portions formed on the medium. As a result, the medium can be transported while the wave pattern formed by the forming section is maintained in a favorable condition, which leads to good recording quality.

It is preferable that in the recording apparatus, a position of each of the transport roller pairs be in alignment with a position of a vertex of each of the first convex portions of the medium in a normal direction normal to the vertex of each of the first convex portions.

According to this configuration, the position of each of the transport roller pairs is in alignment with the position of the vertex of each of the first convex portions of the medium in the normal direction normal to the vertex of each of the first convex portions. As a result, the medium having the wave pattern can be nipped smoothly by the transport roller pairs, which serve as the upstream-side transport section. In addition, the wave pattern is readily maintained after the transport roller pairs nip the medium.

It is preferable that in the recording apparatus, the forming section include first contact portions that come into contact with a first side of the medium that faces the recording section and second contact portions that come into contact with a second side of the medium that is opposite to the first side and that the first contact portions and the second contact portions be disposed alternately in the width direction with spacing therebetween. It is also preferable that respective end portions of the first contact portions and respective end portions of the second contact portions partially overlap each other in the normal direction when viewed in the width direction. According to this configuration, the wave pattern can be formed on the medium with a simple structure.

It is preferable that in the recording apparatus, the forming section be formed such that one of the first contact portions is disposed at each end of the medium having a predetermined size in the width direction.

According to this configuration, the forming section is formed such that one of the first contact portions is disposed at each widthwise end of the medium having a predetermined size. As a result, the wave pattern can be made in which the widthwise ends of the medium are oriented in a direction away from the recording section. This can reduce the likelihood of the widthwise ends of the medium coming into contact with the recording section.

It is preferable that in the recording apparatus, the forming section be formed such that pressing amounts of the first contact portions that press the medium toward the second contact portions are changeable.

According to this configuration, the forming section is formed such that pressing amounts of the first contact portions that press the medium toward the second contact portions are changeable. As a result, the height of the first convex portions and the height of the second convex portions can be adjusted in accordance with types of media that are different in, for example, rigidity or thickness.

It is preferable that in the recording apparatus, the pressing amounts of the first contact portions that press the medium toward the second contact portions increase as a distance from upstream ends of the first contact portions in the medium transport direction increases.

According to this configuration, the pressing amounts of the first contact portions that press the medium toward the second contact portions increase as the distance from the upstream ends of the first contact portions in the medium transport direction increases. As a result, the medium being transported can be introduced smoothly between the first contact portions and the second contact portions, thereby forming the wave pattern smoothly.

It is preferable that in the recording apparatus, the pressing amounts of the first contact portions that press the medium toward the second contact portions be such that the pressing amounts of the first contact portions located at a center in the width direction are larger than those of the first contact portions located at ends in the width direction.

When a wave pattern is formed on a medium while the first contact portions and the second contact portion are set at the same pressing amount over the entire width, the amount of power required for forming the wave pattern is greater at the center compared with the amount of power required at both ends because at the center, a larger area of the medium is affected by gathering the medium for forming the wave pattern. According to this configuration, the pressing amounts of the first contact portions that press the medium toward the second contact portions are such that the pressing amounts of the first contact portions located at the center in the width direction are larger than those of the first contact portions located at both end in the width direction. As a result, the wave pattern at the center can be formed reliably.

It is preferable that in the recording apparatus, the first contact portions have respective first regions and respective second regions located downstream of the first regions in the medium transport direction and that the first regions and the second regions be regions in which the first contact portions press the medium toward the second contact portions. It is also preferable that the pressing amounts for pressing the medium in the first regions of the first contact portions that are disposed in the width direction be the same, and that the pressing amounts for pressing the medium in the second regions of the first contact portions located at a center in the width direction be larger than those in the second regions of the first contact portions located at ends in the width direction.

According to this configuration, the forming section includes the first regions and the second regions. As a result, the wave pattern can be formed readily and smoothly.

It is preferable that the recording apparatus further include a preliminary transport roller pair that transports the medium toward the forming section. In the recording apparatus, it is preferable that the preliminary transport roller pair nip a portion of the medium in the width direction.

If a single roller pair that transports a medium toward the forming section is formed so as to nip the entire width of the medium, the medium that reaches the forming section does not move flexibly in the width direction, which makes it difficult to form a wave pattern. According to this configuration, a preliminary transport roller pair that transports the medium toward the forming section nip a portion of the medium in the width direction. As a result, the forming section can form the wave pattern on the medium reliably.

It is preferable that the recording apparatus further include a preliminary forming section that is disposed upstream of the forming section in the medium transport direction and that forms first small convex portions and second small convex portions on the medium. It is also preferable that in the recording apparatus, the first small convex portions be smaller than the first convex portions and the second small convex portions be smaller than the second convex portions, the first convex portions and the second convex portions being formed on the medium by the forming section.

According to this configuration, the preliminary forming section that is disposed upstream of the forming section in the medium transport direction forms a small preliminary wave pattern, and subsequently, the forming section forms a more distinctive wave pattern. Thus, it is easier to form the wave pattern on the medium.

It is preferable that in the recording apparatus, the downstream-side transport section include discharge roller pairs that are disposed in the width direction and that nip and transport the medium, and that, of the first convex portions and the second convex portions that are formed on the medium, the discharge roller pairs nip the first or second convex portions that have been nipped by the transport roller pairs.

According to this configuration, the downstream-side transport section includes discharge roller pairs that are disposed in the width direction and the discharge roller pairs nip and transport the medium at either the first convex portions or the second convex portions. As a result, the wave pattern can be effectively maintained between the discharge roller pairs and the transport roller pairs serving as the upstream-side transport section, in other words, the wave pattern can be effectively maintained in a recording region of the recording section.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Example 1

Figure 1:
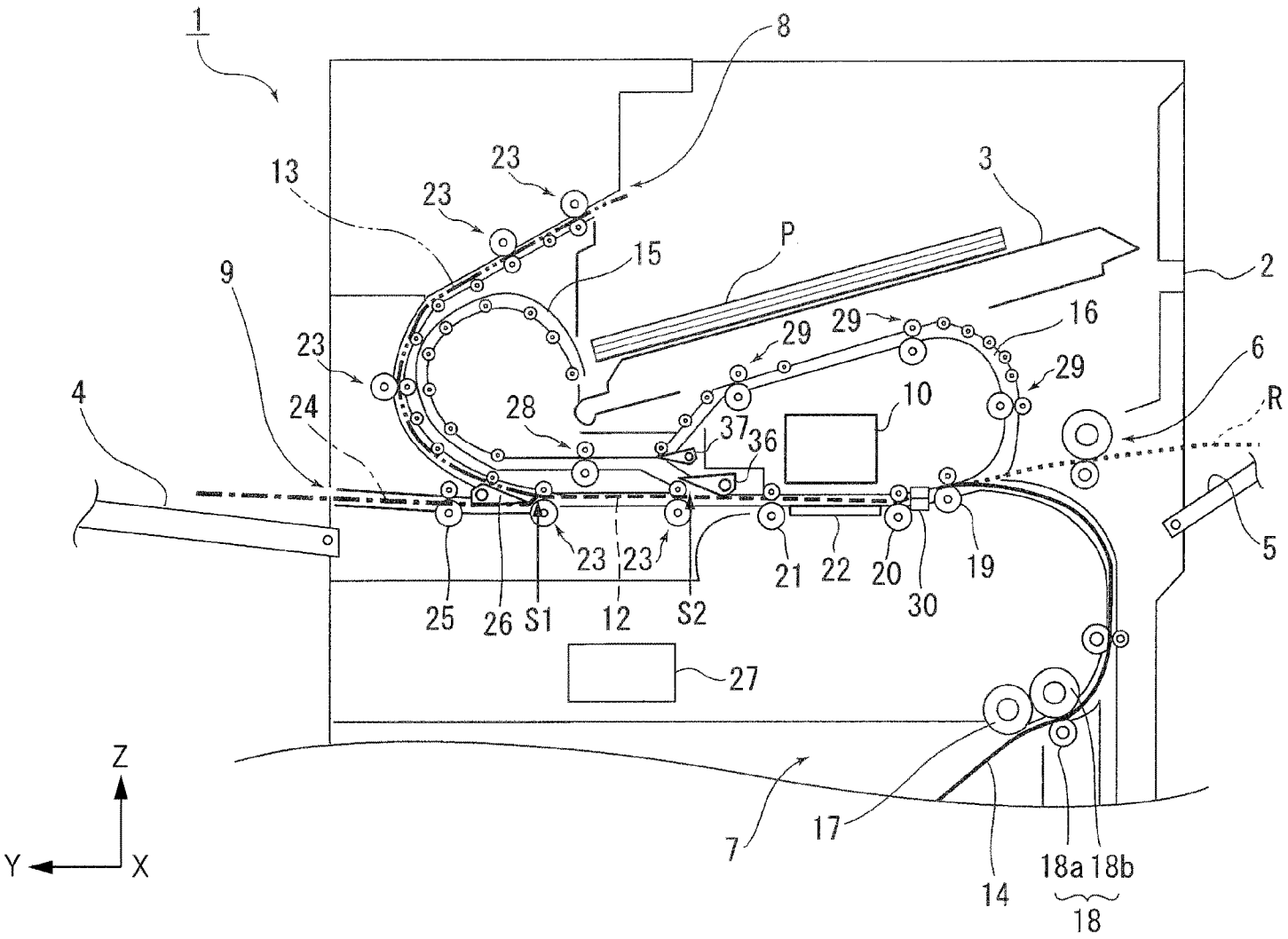
FIG. 1 is a view schematically illustrating sheet transport paths in a printer according to Example 1.
Figure 2:
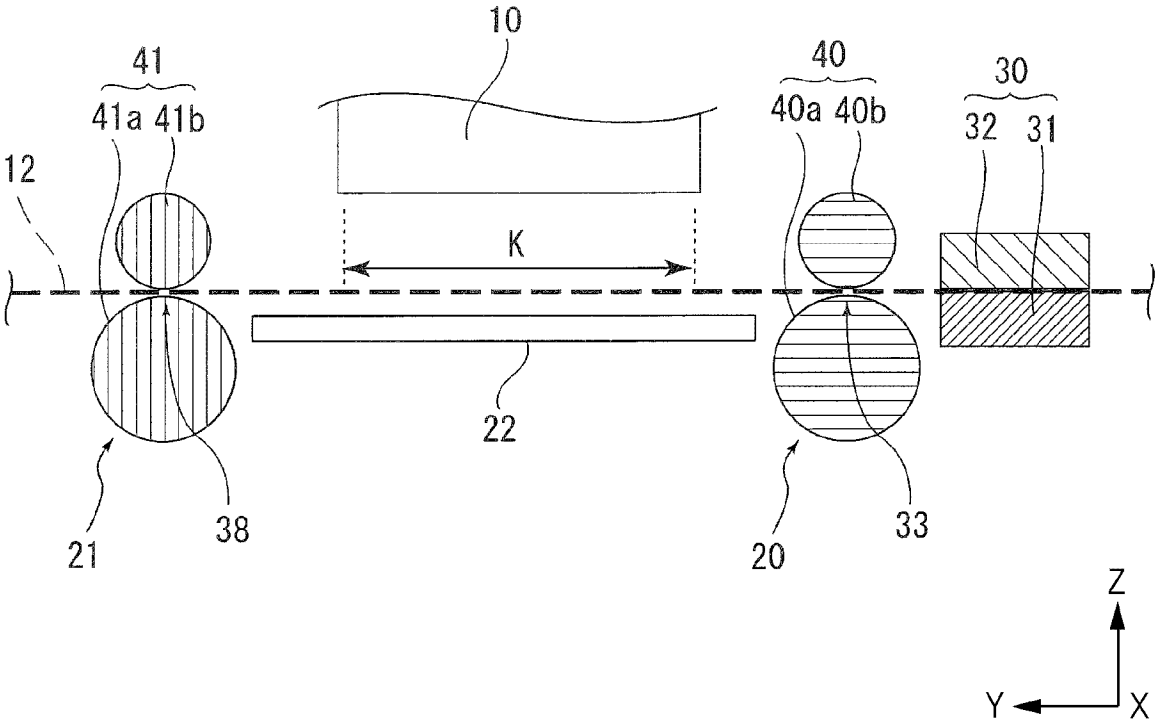
FIG. 2 is a side view schematically illustrating the vicinity of a recording section.
Figure 3:
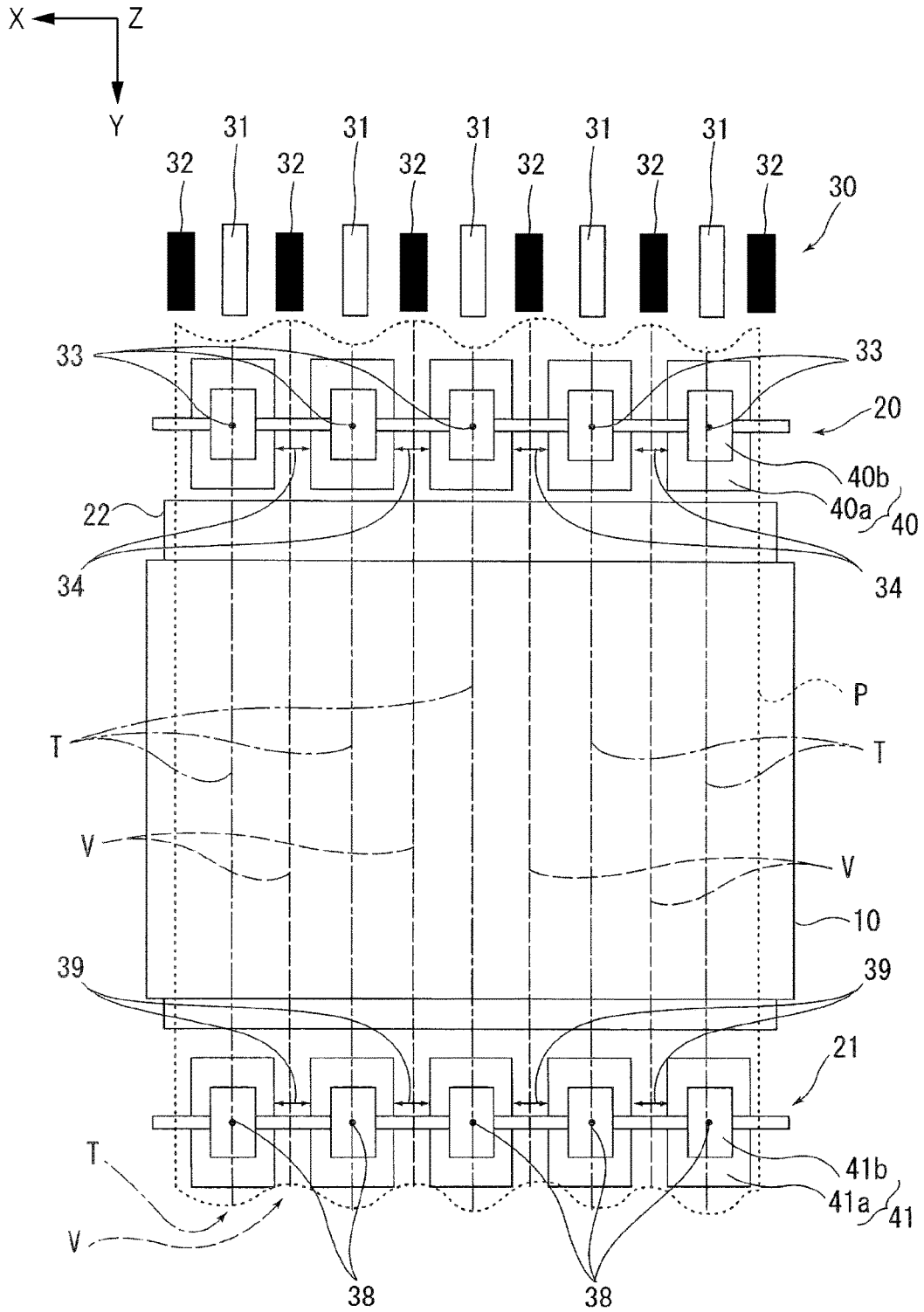
FIG. 3 is a plan view schematically illustrating the vicinity of a recording section.
Figure 4:
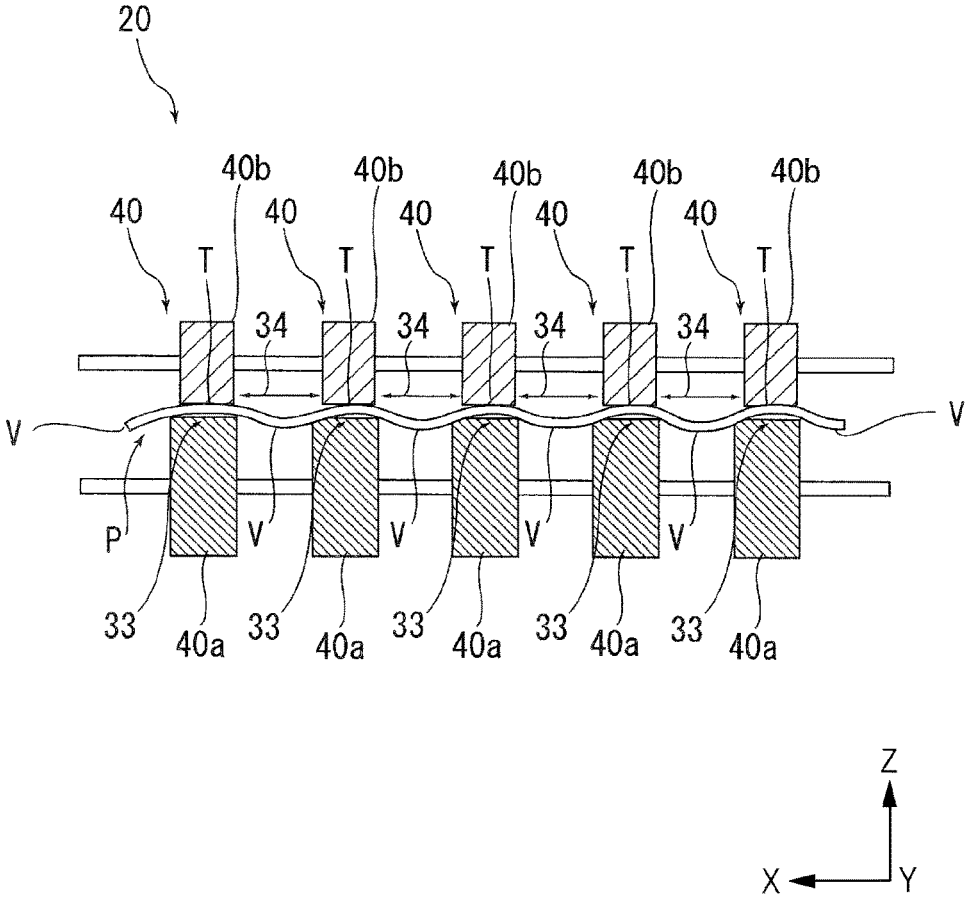
FIG. 4 is a cross-sectional view illustrating an upstream-side transport section according to Example 1 that is cut along the Z-X plane
Figure 5:
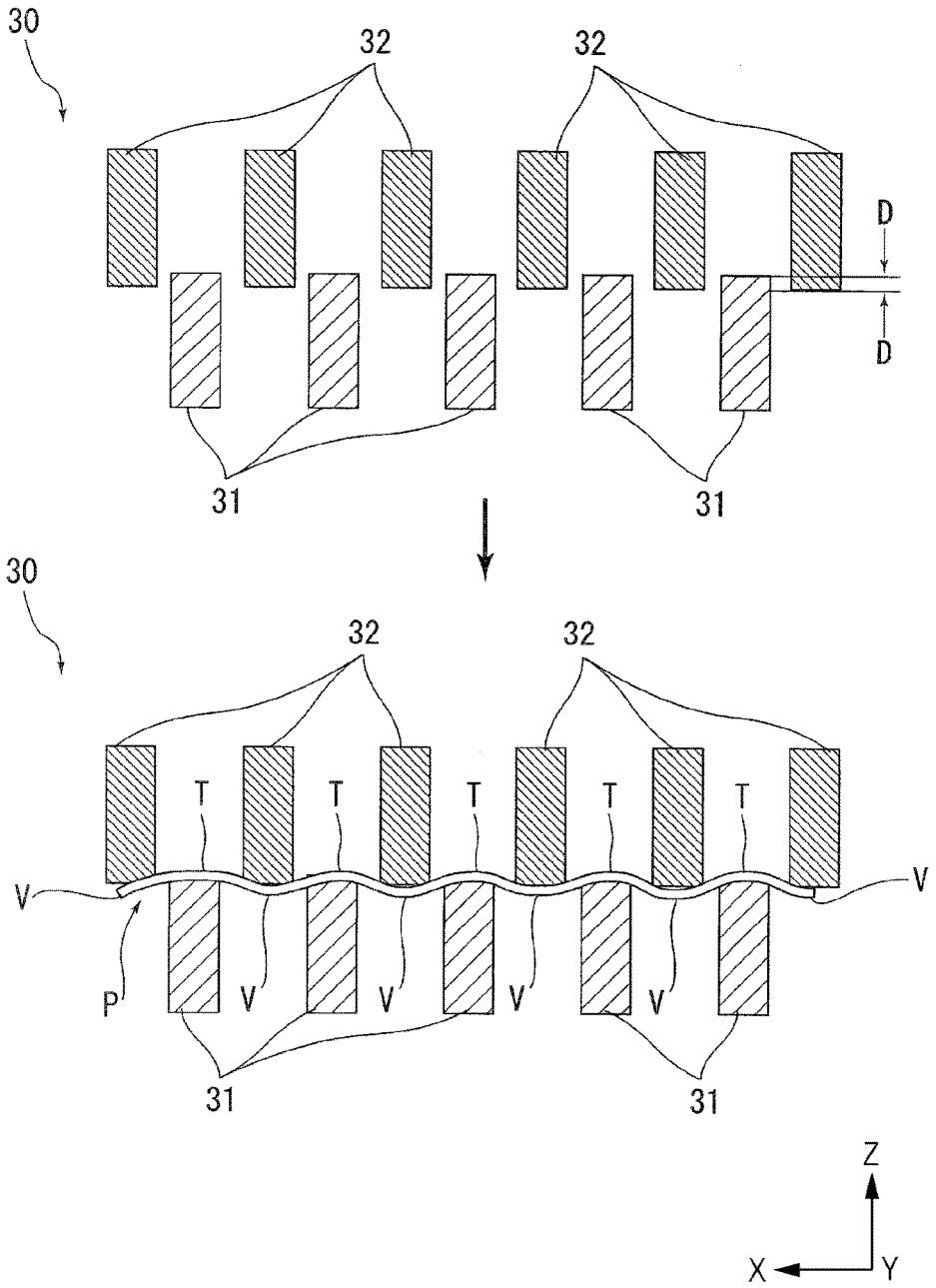
FIG. 5 is a cross-sectional view illustrating a wave-pattern-forming section according to Example 1 that is cut along the Z-X plane.
Figure 6:
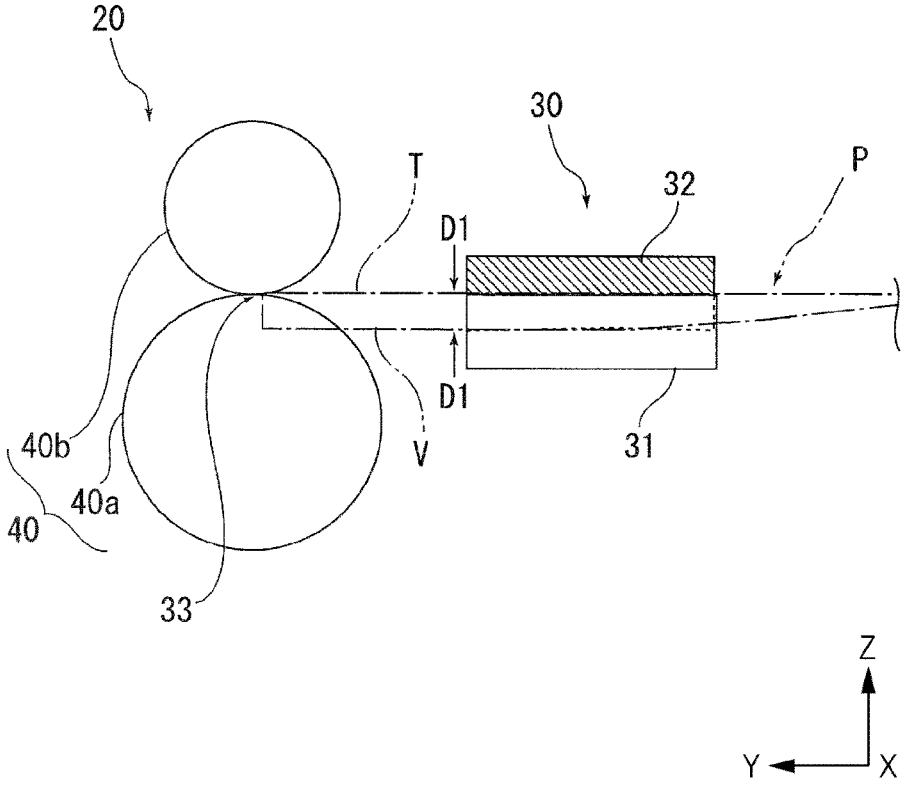
FIG. 6 is a view schematically illustrating a positional relationship between the upstream-side transport section and the wave-pattern-forming section in the height direction.
Figure 7:
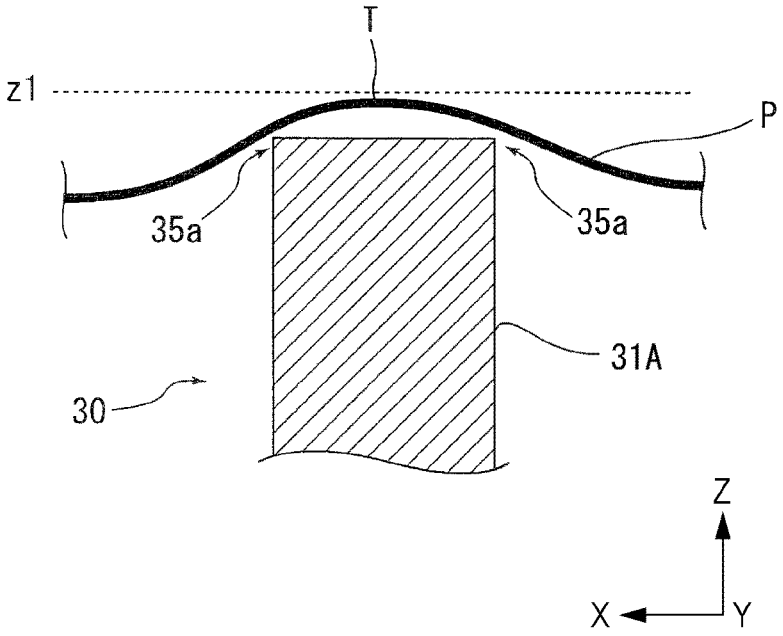
FIG. 7 is a cross-sectional view illustrating an end shape example of a support rib that is cut along the Z-X plane.
Figure 8:
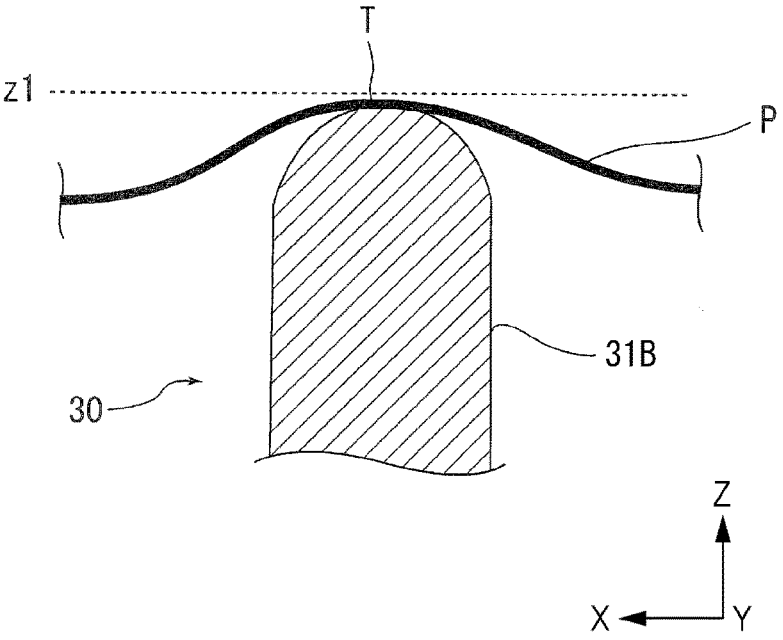
FIG. 8 is a cross-sectional view illustrating another end shape example of the support rib that is cut along the Z-X plane.
Figure 9:
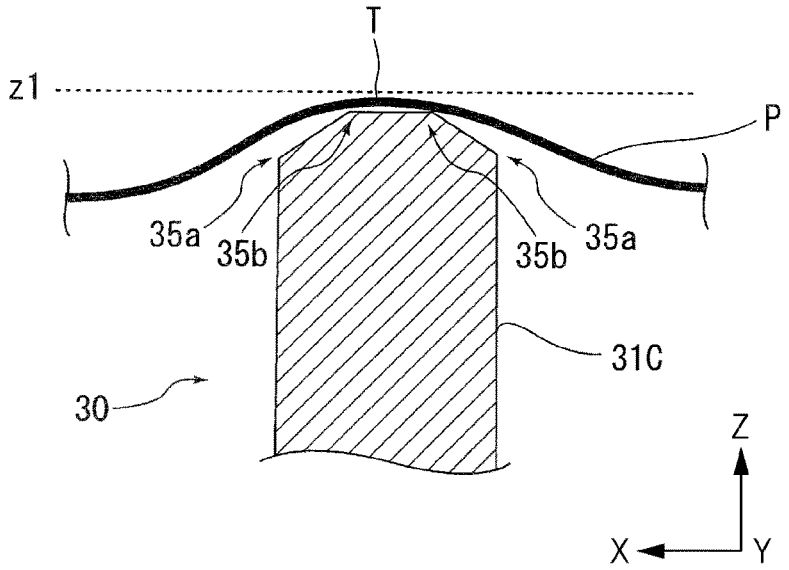
FIG. 9 is a cross-sectional view illustrating another end shape example of the support rib that is cut along the Z-X plane.

First, an example of a recording apparatus according to the disclosure will be outlined. As an example of the recording apparatus, an ink jet printer 1 (which may be simply referred to as a "printer 1") will be described. FIG. 1 is a view schematically illustrating sheet transport paths in a printer according to Example 1. FIG. 2 is a side view schematically illustrating the vicinity of a recording section. FIG. 3 is a plan view schematically illustrating the vicinity of a recording section. FIG. 4 is a cross-sectional view illustrating an upstream-side transport section according to Example 1 that is cut along the Z-X plane. FIG. 5 is a cross-sectional view illustrating a wave-pattern-forming section (forming section) according to Example 1 that is cut along the Z-X plane. FIG. 6 is a view schematically illustrating a positional relationship between the upstream-side transport section and the wave-pattern-forming section in the height direction. FIG. 7 is a cross-sectional view illustrating an end shape example of a support rib that is cut along the Z-X plane. FIG. 8 is a cross-sectional view illustrating another end shape example of the support rib that is cut along the Z-X plane. FIG. 9 is a cross-sectional view illustrating another end shape example of the support rib that is cut along the Z-X plane.

Figure 10:
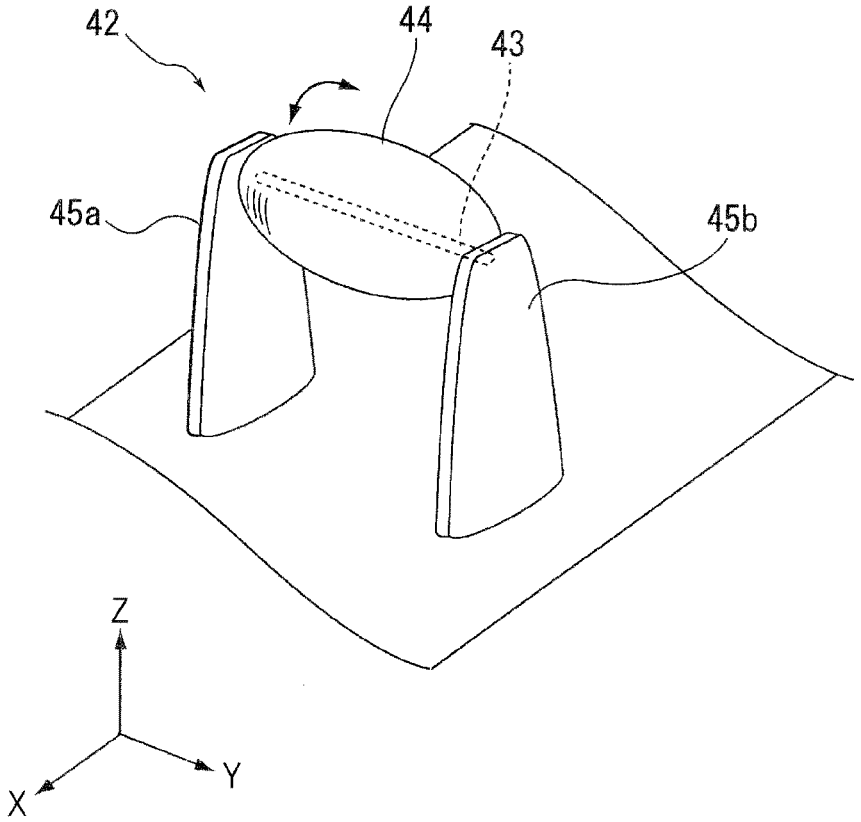
FIG. 10 is a perspective view illustrating another example of the support rib.
Figure 11:
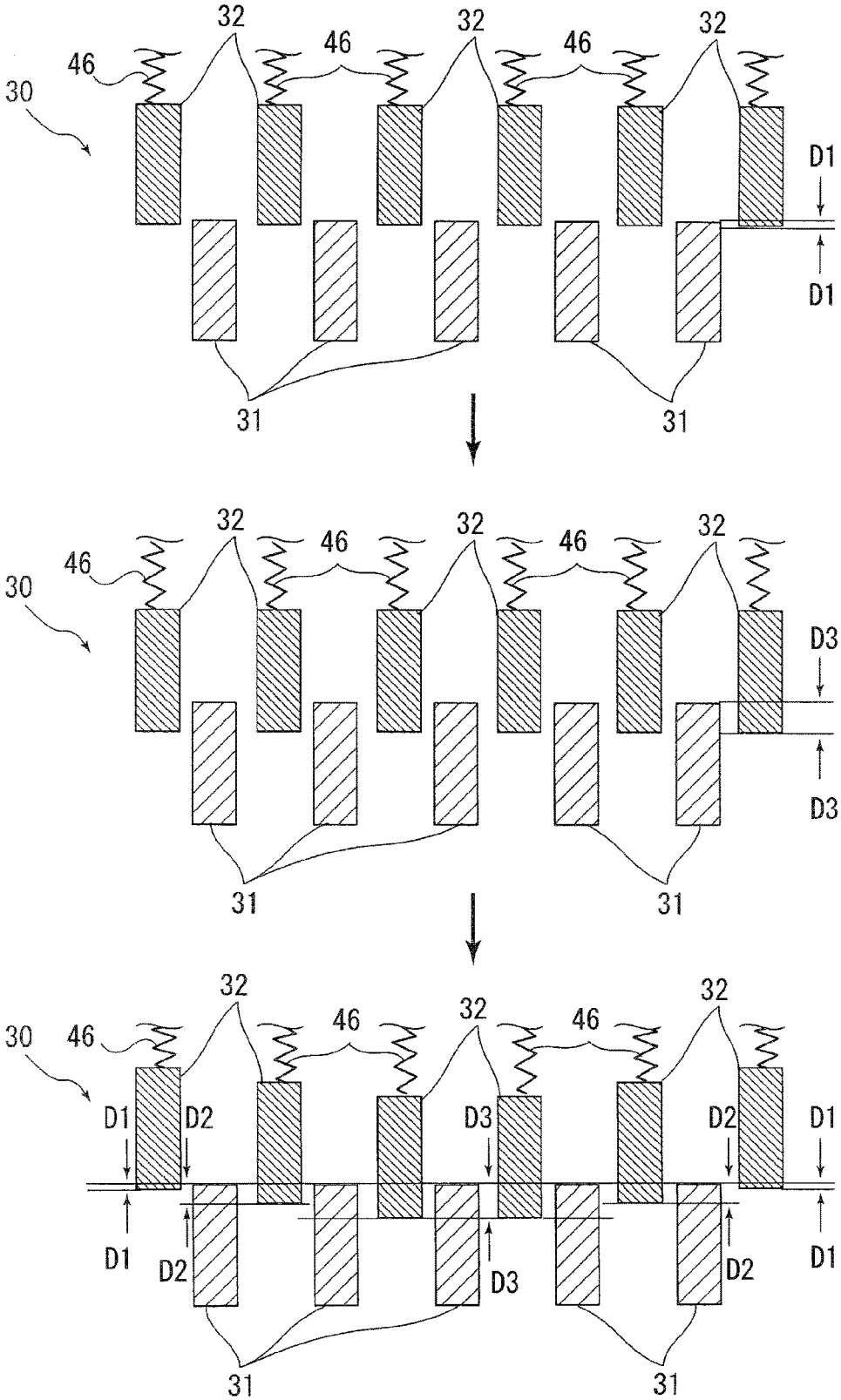
FIG. 11 is a cross-sectional view illustrating an example of pressing members that are cut along the Z-X plane.
Figure 12:
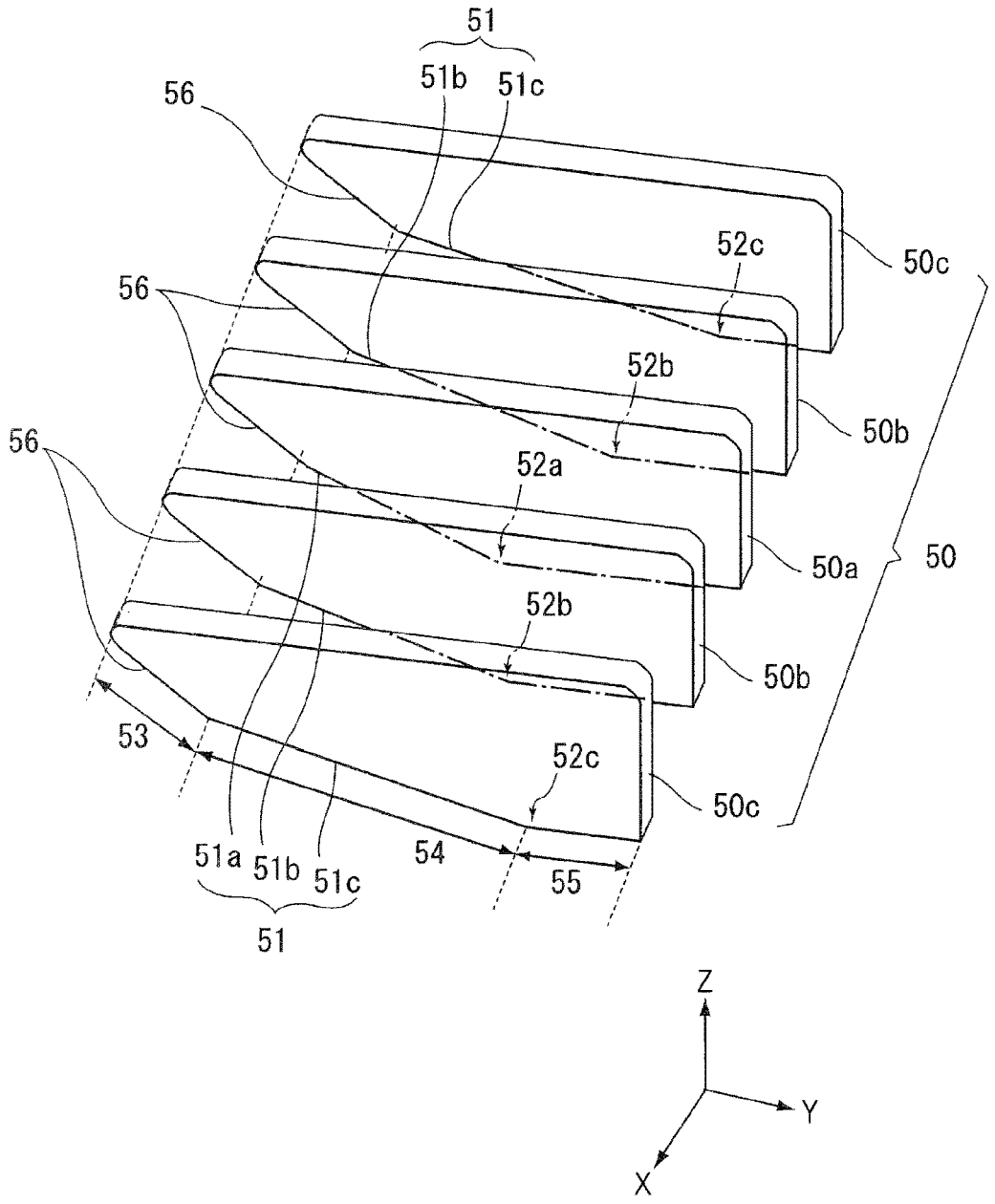
FIG. 12 is a perspective view illustrating another example of the pressing members.
Figure 13:
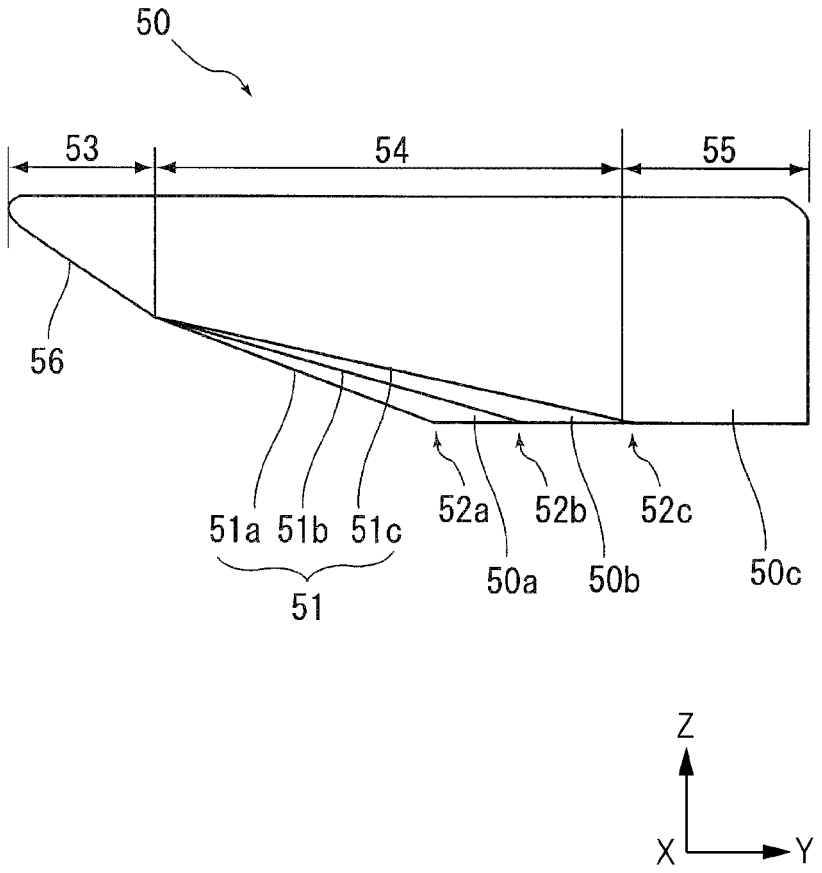
FIG. 13 is a side view illustrating the pressing members in FIG. 12.
Figure 14:
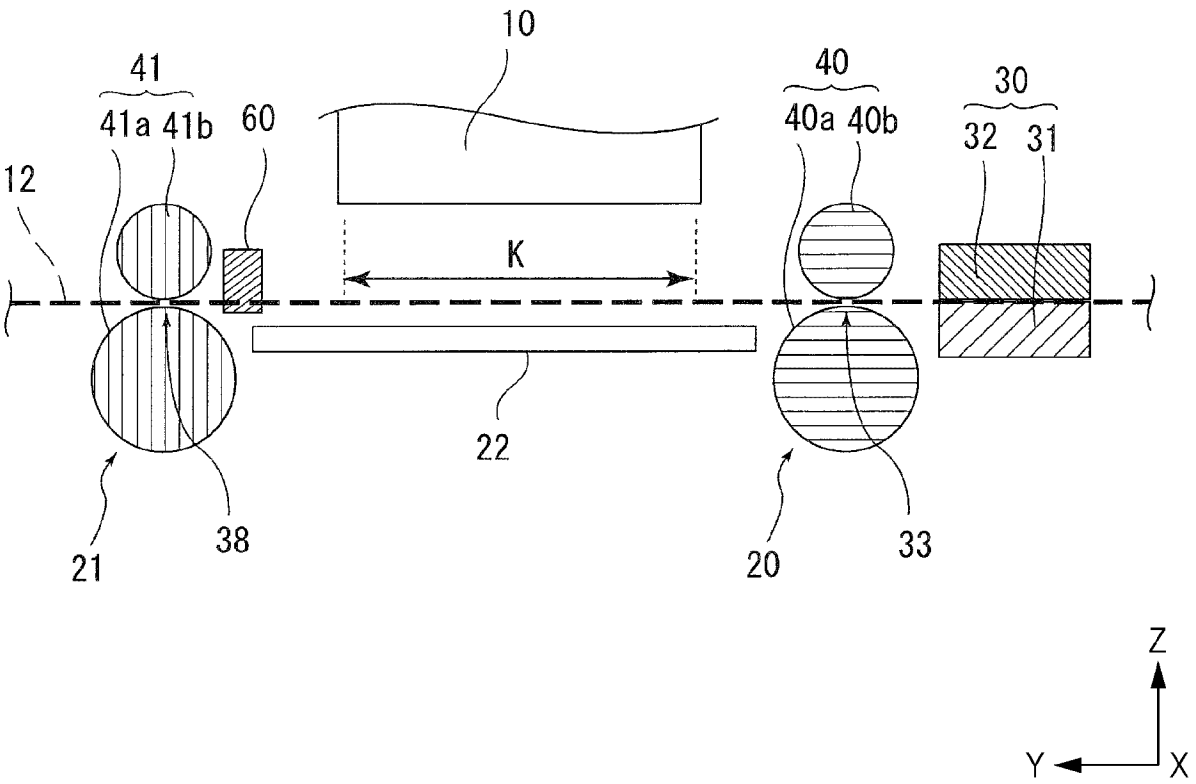
FIG. 14 is a side view schematically illustrating secondary pressing members.
Figure 15:
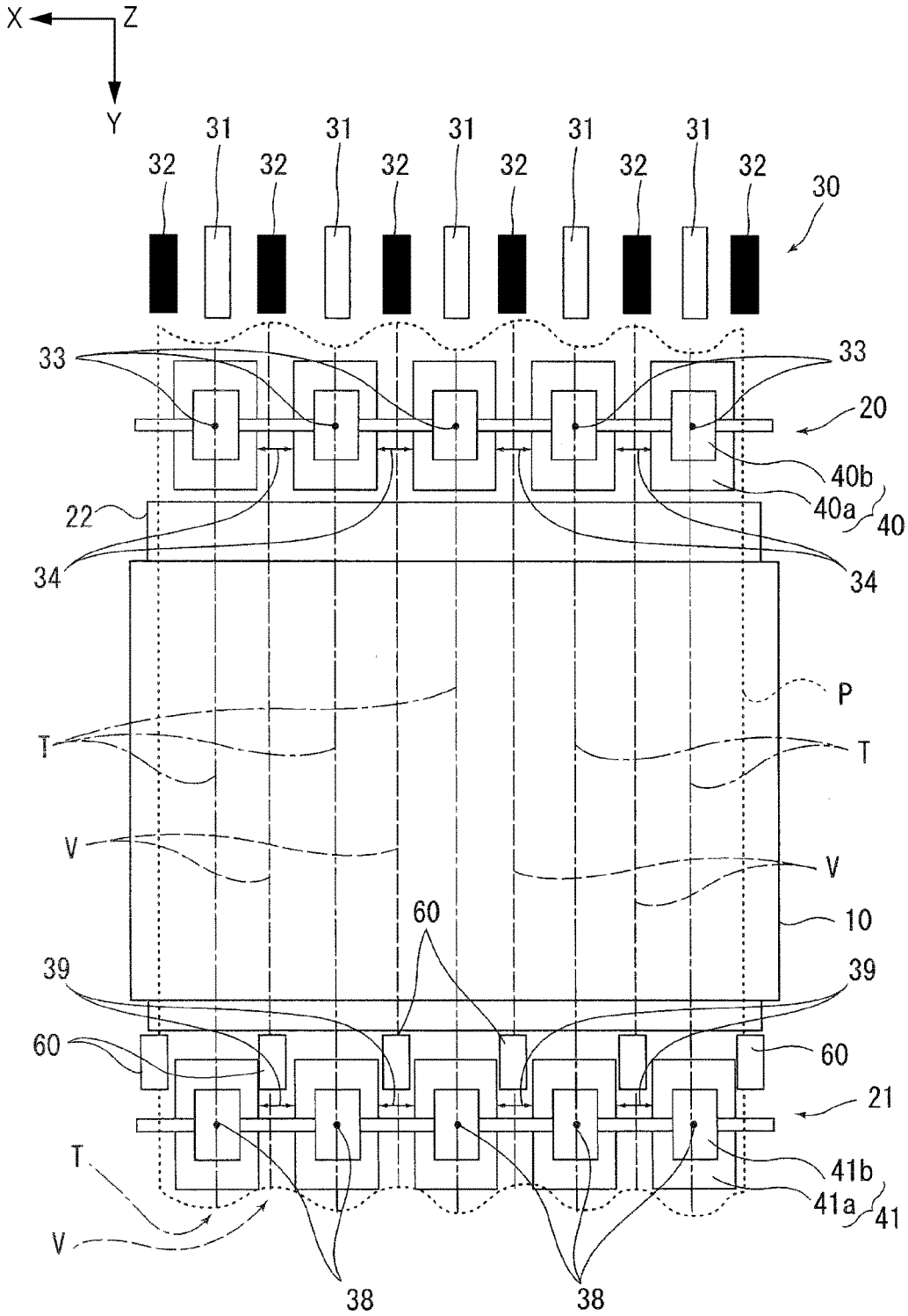
FIG. 15 is a plan view schematically illustrating the secondary pressing members.
Figure 16:
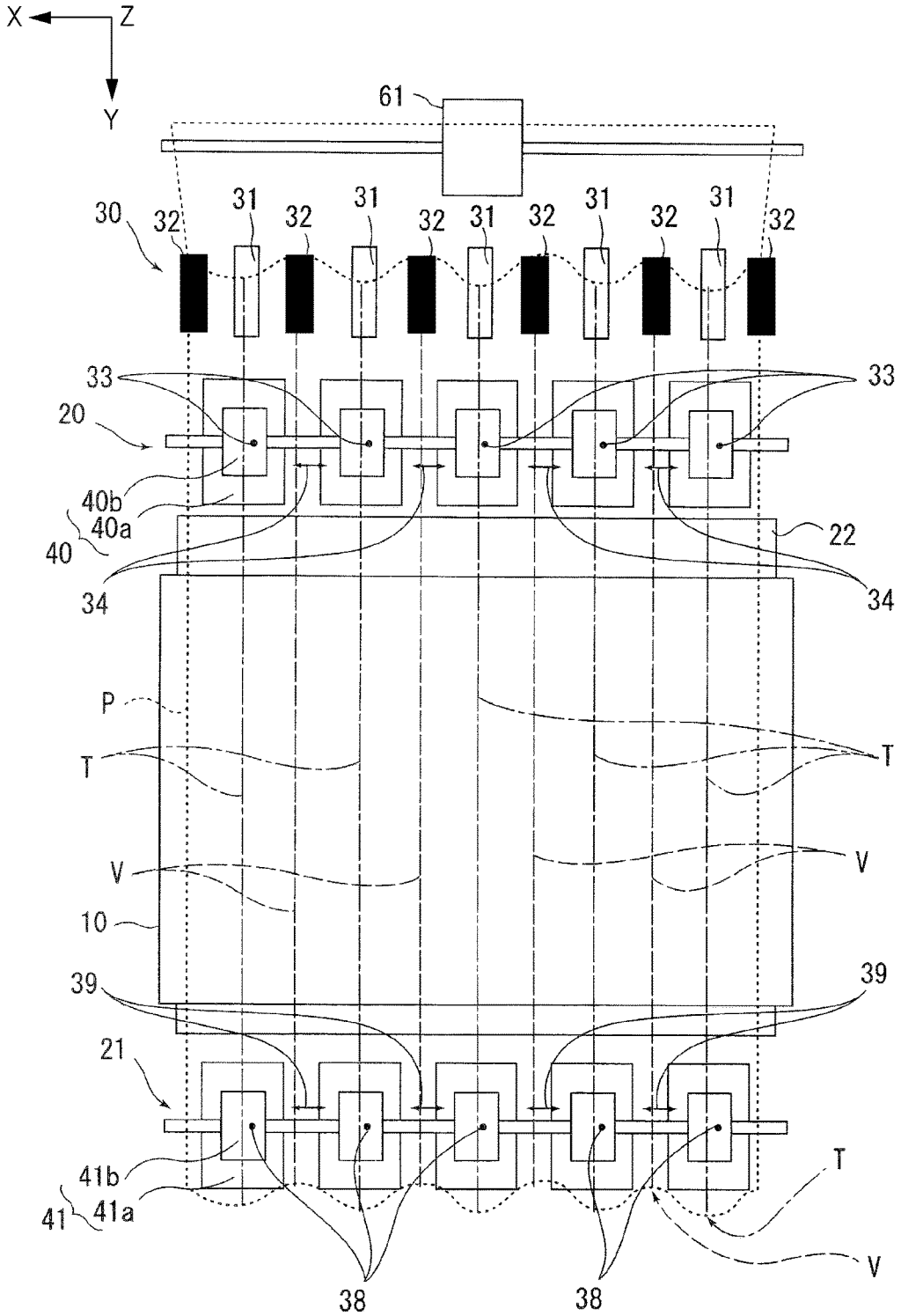
FIG. 16 is a plan view schematically illustrating a preliminary transport roller pair.
Figure 17:
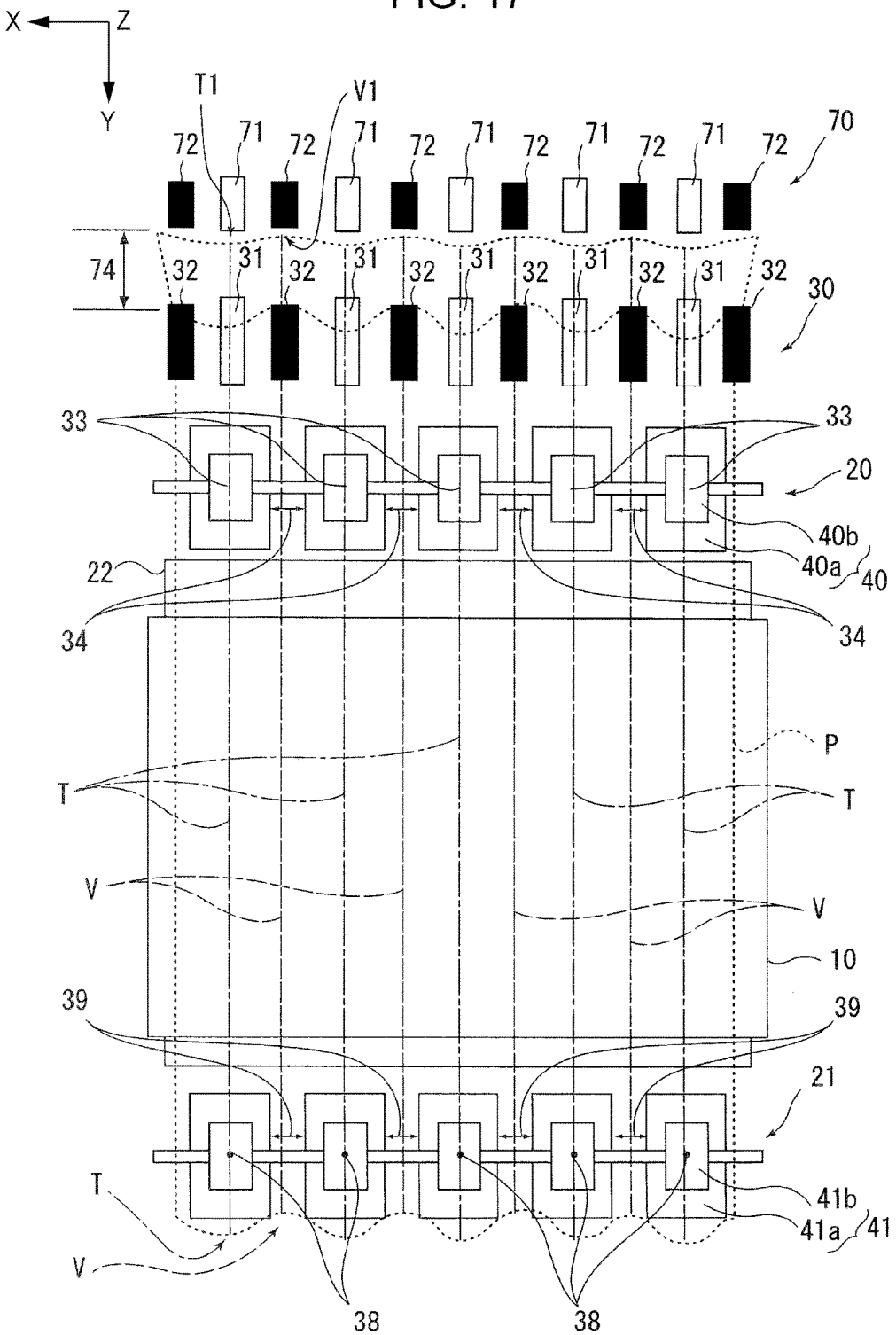
FIG. 17 is a plan view schematically illustrating a preliminary wave-pattern-forming section.
Figure 18:
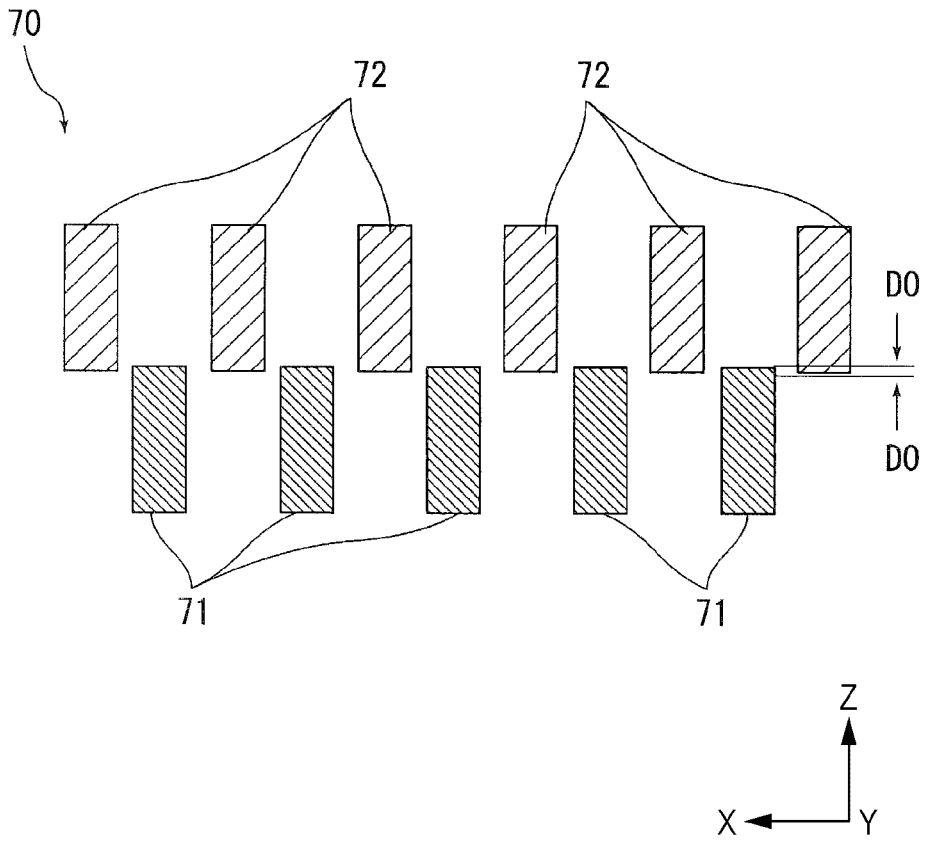
FIG. 18 is a cross-sectional view illustrating the preliminary wave-pattern-forming section that is cut along the Z-X plane.

FIG. 10 is a perspective view illustrating another example of the support rib. FIG. 11 is a cross-sectional view illustrating an example of pressing members that are cut along the Z-X plane. FIG. 12 is a perspective view illustrating another example of the pressing members. FIG. 13 is a side view illustrating the pressing members in FIG. 12. FIG. 14 is a side view schematically illustrating secondary pressing members. FIG. 15 is a plan view schematically illustrating the secondary pressing members. FIG. 16 is a plan view schematically illustrating a preliminary transport roller pair. FIG. 17 is a plan view schematically illustrating a preliminary wave-pattern-forming section (preliminary forming section). FIG. 18 is a cross-sectional view illustrating the preliminary wave-pattern-forming section that is cut along the Z-X plane.

In the X-Y-Z coordinate system indicated in each drawing, the X-axis direction represents the width direction of a sheet of paper, which is the width direction of the recording apparatus, and the Y-axis direction represents the transport direction of a sheet of paper (medium transport direction) in the transport path in the recording apparatus, which is the depth direction of the recording apparatus. The Z-axis direction represents the height direction of the recording apparatus. The direction in which a sheet of paper is transported is referred to as "downstream" and the opposite direction is referred to as "upstream".

Outline of Printer

A printer 1 illustrated in FIG. 1 includes a line head 10, which is an example of a recording section. The line head 10 is disposed inside the apparatus body 2 and performs printing by ejecting liquid onto a sheet of paper, which is an example of a medium. Here, in the embodiment, the liquid is a water-based ink, such as an aqueous ink. The printer 1 is formed so as to be able to perform double-sided recording in which recording is performed on a first side of a sheet (otherwise called a "front side" of a sheet), and subsequently, after the sheet is inverted, recording is performed on the second side of the sheet (otherwise called the "back side" of the sheet).

A plurality of paper cassettes 7 are disposed in a lower region of the printer 1. Sheets accommodated in the paper cassettes 7 are sent one by one toward the line head 10 and recording is performed on each sheet. The printer 1 is formed such that the sheet on which the line head 10 has performed recording is discharged to either a first discharge section 8 or a second discharge section 9. The sheet sent through the first discharge section 8 is stacked in a first medium placement section 3 disposed above the line head 10. Otherwise, the sheet is sent through the second discharge section 9 and stacked in a second medium placement section 4 disposed in a side region in the +Y-axis direction.

Transport Path of Printer

Next, transport paths for sheets in the printer 1 will be described with reference to FIG. 1. As follows, a transport path, on which a sheet is discharged immediately after recording is performed on the first side, will be described first, and another transport path for the double-sided recording will be described thereafter.

A paper cassette 7 can accommodate a plurality of sheets, and the uppermost sheet is transported to a feed path 14 (indicated by the thick solid line in FIG. 1), which is located downstream in the medium transport direction. Along the feed path 14, a feed roller 17 and a separation roller pair 18 that separates sheets one by one are disposed in this order in the medium transport direction. The feed roller 17 is rotationally driven by a drive source (not illustrated). The separation roller pair 18, otherwise called "retard rollers", includes a drive roller 18*b* and an idler roller 18*a*. The drive roller 18*b* sends a sheet toward a straight path 12 (indicated by the dashed line in FIG. 1), which will be described later below. The idler roller 18*a* nips sheets with the drive roller 18*b* and separates the sheets.

The uppermost sheet accommodated in a paper cassette 7 is picked up and transported downstream by the feed roller 17. If a subsequent sheet is transported together with the uppermost sheet, the separation roller pair 18 separates the uppermost sheet from the subsequent sheet so that only the uppermost sheet is transported to the feed path 14.

A resist roller pair 19 is disposed downstream of the separation roller pair 18 in the transport direction. In the present example, the feed path 14 is connected to the straight path 12 at the resist roller pair 19. The straight path 12 is formed so as to extend substantially straight and is equipped, downstream of the resist roller pair 19, with an upstream-side transport section 20, the line head 10, and a downstream-side transport section 21. The straight path 12 also includes a recording region K (FIG. 2) in which the line head 10 performs recording.

The upstream-side transport section 20 is a transport section disposed upstream of the line head 10 in the medium transport direction. The downstream-side transport section 21 is another transport section disposed downstream of the line head 10 in the medium transport direction. In addition, a medium-support platform 22 is disposed in a region that faces the head surface of the line head 10. The medium-support platform 22 supports a sheet on the side thereof that is opposite to the recording side.

A wave-pattern-forming section 30 is disposed upstream of the upstream-side transport section 20 in the medium transport direction. The wave-pattern-forming section 30 is a section that forms a wave pattern on a sheet P (see FIG. 3) that is transported. The wave pattern is formed of first convex portions T (ridge portions T) that protrude from one side of the sheet P and extend in the medium transport direction and of second convex portions V (trough portions V) that protrude from the other side of the sheet P and extend in the medium transport direction. The first convex portions T and the second convex portions V are alternately disposed in the width direction, which intersects the medium transport direction. The wave pattern formed on the sheet P makes the sheet P tougher and more rigid, which causes the orientation of the sheet P on the medium-support platform 22 to be stable. As a result, favorable recording quality is obtained in recording performed by the line head 10. A more detailed description on the upstream-side transport section 20, the downstream-side transport section 21, and the wave-pattern-forming section 30, which are elements having characteristics of the disclosure, will be given later.

The line head 10 is formed so as to perform recording by ejecting ink (liquid) onto the recording side of a sheet when the sheet is transported into the recording region K (FIG. 2) that faces the line head 10 on the medium-support platform 22. The line head 10 is formed as a recording head in which nozzles that eject ink are disposed so as to cover the entire width of a sheet and perform recording over the entire width without moving in the medium width direction. Note that although the printer 1 according to the present example includes the line head 10, the printer 1 may be equipped with a serial-type recording head that is mounted on a carriage and performs recording by ejecting liquid onto a medium while reciprocating in a direction intersecting the medium transport direction.

The printer 1 is formed such that in recording, sheets can be fed from a manual feeder tray 5 as well as from the paper cassette 7. In FIG. 1, the dotted line R indicates a transport path when a sheet is fed from the manual feeder tray 5. A sheet fed from the manual feeder tray 5 is transported by a transport roller pair 6 to the straight path 12, and the line head 10 performs recording on the sheet in a manner similar to the sheet fed from the paper cassette 7.

The sheet on which the line head 10 has performed recording is subsequently sent from the straight path 12 to either a first discharge path 13 or a second discharge path 24 depending on the discharge destination of the sheet after recording. The first discharge path 13 is a curved path that is connected to the straight path 12 downstream of the line head 10. The sheet is sent along the first discharge path 13 and discharged from the first discharge section 8 with the recording side of the sheet facing down. The second discharge path 24 is a path that extends straight from the straight path 12 downstream of the line head 10. The sheet is sent along the second discharge path 24 and discharged from the second discharge section 9 with the recording side of the sheet facing up.

A switching section 26, such as a guide flap, that switches the sheet after recording to different destinations is disposed at a branching position S1 at which the first discharge path 13 and the second discharge path 24 branch from the straight path 12. Switching of the switching section 26 is controlled by a control section 27. Note that in the printer 1, the control section 27 also controls transport of sheets (driving of various transport roller pairs, etc.) as well as operations related to recording, such as the switching of the switching section 26.

The sheet, which has been sorted at the switching section 26 and sent to the first discharge path 13 from the straight path 12, is subsequently transported by transport roller pairs 23, discharged from the first discharge section 8, and placed onto the first medium placement section 3 with the recording side facing down. Otherwise the sheet sent to the second discharge path 24 from the straight path 12 is subsequently transported by a transport roller pair 25, discharged from the second discharge section 9, and placed onto the second medium placement section 4 with the recording side facing up.

Next, a transport path for double-sided recording will be described. The printer 1 (FIG. 1) includes a switchback path 15 and an inversion path 16. The switchback path 15 branches from the straight path 12 at a position downstream of the line head 10 and upstream of the first discharge path 13 (in the embodiment, upstream of the transport roller pairs 23 in FIG. 1). The inversion path 16, which is connected to the switchback path 15, causes a sheet to be inverted from the front side to the back side (from the first side to the second side) and return to the straight path 12. A guide flap 36 is disposed at a branching position S2 at which the switchback path 15 branches from the straight path 12, and a guide flap 37 is also disposed at a connecting position between the switchback path 15 and the inversion path 16. The guide flaps 36, 37 switch between paths to which the sheet is sent. The action of the guide flaps 36, 37 is controlled by the control section 27.

When the printer 1 performs the double-sided recording, a sheet after recording on the first side is first transported to the switchback path 15 and subsequently to the inversion path 16. The inversion path 16 is connected to the straight path 12 at a position upstream of the straight path 12. Accordingly, the sheet, which has been inverted along the inversion path 16, is sent to the straight path 12 with the second side facing the line head 10. Recording on the second side is subsequently performed. The sheet, on which recording is performed on the second side, is sorted at the switching section 26 and discharged from the first discharge section 8 via the first discharge path 13 or from the second discharge section 9 via second discharge path 24.

Upstream-Side Transport Section

The upstream-side transport section 20 (FIGS. 2 to 4) is formed of upstream-side transport roller pairs 40, which serve as transport roller pairs that nip and transport a sheet P. The upstream-side transport roller pairs 40 include upstream-side drive rollers 40*a*, which are driven by a drive source (not illustrated), and upstream-side idler rollers 40*b*. As described above, the wave-pattern-forming section 30 is disposed upstream of the upstream-side transport section 20. Accordingly, the upstream-side transport section 20 nips a sheet P that has a wave pattern in which the first convex portions T and the second convex portions V, both of which extend in the medium transport direction, are alternately disposed in the width direction, which intersects the medium transport direction. In the case where, for example, a single roller pair formed to extend cylindrically in the width direction is used in the upstream-side transport section 20, it is likely that when the sheet P is nipped, the roller pair acts so as to remove the wave pattern, in other words, the wave pattern becomes flattened, squashed, and so on.

In contrast, the upstream-side transport section 20 (FIGS. 3 and 4) according to the embodiment is formed such that nipping portions 33 and relieving spaces 34 are disposed alternately in the width direction. The nipping portions 33 nip either the first convex portions T or the second convex portions V, whereas the relieving spaces 34 relieve the convex portions that are not nipped. More specifically, as illustrated in FIG. 3 and FIG. 4, a plurality of roller pairs are disposed with spacing provided therebetween in the width direction (X-axis direction), which intersects the medium transport direction. FIG. 4 illustrates a state in which the nipping portions 33 of the upstream-side transport roller pairs 40 nip the first convex portions T of the wave pattern of the sheet P while the second convex portions V of the sheet P are positioned in the relieving spaces 34. In this state, the wave pattern is maintained without being flattened. The relieving spaces 34 represent gaps provided in such a manner between adjacent nipping portions 33.

With the upstream-side transport section 20 formed in such a manner, the following advantageous effects can be obtained. The upstream-side transport section 20 is prevented from acting so as to remove the wave pattern formed by the wave-pattern-forming section 30. In other words, the sheet P can be transported while the wave pattern formed by the wave-pattern-forming section 30 is maintained in a favorable condition, which contributes to good recording quality.

Note that in the embodiment, the upstream-side transport section 20 is formed such that individual roller pairs (upstream-side transport roller pairs 40) are disposed with spacing that serves as the relieving spaces therebetween. However, the upstream-side transport section 20 is not limited to this configuration. For example, a single roller pair that extends in the width direction may have nipping portions (having a large diameter) and unnipping portions (having a small diameter), and the unnipping portions may serve as the relieving spaces.

Downstream-Side Transport Section

The downstream-side transport section 21 (FIGS. 2 and 3) is formed similarly to the upstream-side transport section 20 described above. In other words, the downstream-side transport section 21 is formed of downstream-side transport roller pairs 41, which serve as discharge roller pairs that nip and transport a sheet P. The downstream-side transport roller pairs 41 include downstream-side drive rollers 41*a* that are driven by a drive source (not illustrated) and downstream-side idler rollers 41*b*. The downstream-side transport section 21 is formed such that a plurality of roller pairs are disposed with spacing provided therebetween in the width direction (X-axis direction), which intersects the medium transport direction (FIG. 3). In other words, the downstream-side transport section 21 (FIG. 3) is formed such that nipping portions 38 and relieving spaces 39 are disposed alternately in the width direction. The nipping portions 38 nip the first convex portions T or the second convex portions V of the sheet P, whereas the relieving spaces 39 relieve the convex portions that are not nipped by the nipping portions 38.

In the case where, for example, a single roller pair formed to extend cylindrically in the width direction is used in the downstream-side transport section 21, the wave pattern of the sheet P is flattened when nipped by the downstream-side transport section 21. As a result, the sheet P tends to return to an original state before forming of the wave pattern, even in the region between the upstream-side transport section 20 and the downstream-side transport section 21. The wave pattern of the sheet P is thereby deformed while being transported in the recording region K, which may negatively affect the quality of recording on the sheet P.

The nipping portions 38 and the relieving spaces 39 are disposed alternately in the width direction in the downstream-side transport section 21, as in the upstream-side transport section 20. As a result, the wave pattern of the sheet P can be maintained effectively in the recording region K that is located between the upstream-side transport section 20 and the downstream-side transport section 21.

In addition, as illustrated in FIG. 3, the nipping portions 38 in the downstream-side transport section 21 (downstream-side transport roller pairs 41) take positions corresponding to the nipping portions 33 of the upstream-side transport section 20 (upstream-side transport roller pairs 40) in the width direction. As a result, the wave pattern of the sheet P can be maintained effectively in the region between the upstream-side transport section 20 and the downstream-side transport section 21 (especially in the recording region K of the line head 10 in FIG. 2).

Wave-Pattern-Forming Section

The wave-pattern-forming section 30 will be described below with reference to FIGS. 2 to 6. The wave-pattern-forming section 30 is an element that forms, on a sheet P, a wave pattern in which the first convex portions T (indicated by the dash-dot line in FIG. 3) and the second convex portions V (indicated by the dashed line in FIG. 3), both of which extend in the medium transport direction (Y-axis direction), are disposed alternately in the width direction (X-axis direction), which intersects the medium transport direction.

In the embodiment, the wave-pattern-forming section 30 is disposed upstream of the upstream-side transport section 20 as described above (FIGS. 2 and 3). As illustrated in FIG. 5, the wave-pattern-forming section 30 includes pressing members 32 that serve as first contact portions that come into contact with the first side of a sheet P that faces the line head 10. The wave-pattern-forming section 30 also include support ribs 31 that serve as second contact portions that come into contact with the second side of the sheet P that is opposite to the first side. The pressing members 32 and the support ribs 31 are disposed alternately in the width direction with spacing provided therebetween (also see FIG. 3). Moreover, the pressing members 32 and the support ribs 31 are disposed such that the end portions of the pressing members 32 that come into contact with the sheet P partially and the end portions of the support ribs 31 that come into contact with the sheet P partially overlap each other in a direction normal to the sheet P (in the Z direction or height direction in the embodiment) when viewed in the width direction. In the embodiment, as illustrated in FIG. 5, the end portions of the pressing members 32 and the end portions of the support ribs 31 overlap each other at regions indicated by reference D.

As illustrated in the bottom diagram of FIG. 5, when the sheet P is transported between the pressing members 32 and the support ribs 31, the sheet P is pressed downward by the pressing members 32 by the pressing amount indicated by reference D while the sheet P is supported by the support ribs 31. Portions of the sheet P that are supported by the support ribs 31 become the first convex portions T, while portions of the sheet P that are pressed by the pressing members 32 become the second convex portions V, thereby forming a wave pattern on the sheet P. It is desirable that the pressing members 32 and the support ribs 31 be made of a material having a small coefficient of friction (for example, polyoxymethylene or POM). In forming the wave pattern on the sheet P, the pressing members 32 enter between the support ribs 31 and press the sheet P down, the sheet P is squeezed between the pressing members 32 and the support ribs 31. At this time, the sheet P moves little by little in the width direction. Since the pressing members 32 and the support ribs 31 are made of a low frictional material, resistance generated when the wave pattern is formed on the sheet P can be reduced.

In the embodiment, the support ribs 31 are disposed at positions corresponding to the upstream-side transport roller pairs 40 in the width direction (X-axis direction). Accordingly, the first convex portions T of the wave pattern formed on the sheet P are nipped by the upstream-side transport roller pairs 40 at the nipping portions 33. Moreover, as illustrated in FIG. 6, the support ribs 31 are disposed such that the nipping portions 33 and the vertexes of the first convex portions T are positioned at the same level in the direction normal to the surface of the sheet P (Z-axis direction). By disposing the nipping portions 33 and the vertexes of the first convex portions T at the same height level, the sheet P having the wave pattern can be nipped smoothly by the upstream-side transport roller pairs 40, which serve as the upstream-side transport section 20.

If the nipping portions 33 of the upstream-side transport roller pairs 40 and the vertexes of the first convex portions T formed by the wave-pattern-forming section 30 are positioned at different levels in the height direction, the wave pattern may be flattened since the sheet P is stretched in the height direction between the nipping portions 33 of the upstream-side transport roller pairs 40 and the wave-pattern-forming section 30. Note that the nipping portions 33 and the first convex portions T need not be positioned exactly at the same level. If the level of the first convex portions T deviates from the level of the nipping portions 33, for example, by an amount approximately within the range of the radius of a roller of an upstream-side transport roller pair 40 (for example, within the radius of an upstream-side idler roller 40*b*), the sheet P can be transported with the wave pattern being formed and maintained appropriately.

In addition, the wave-pattern-forming section 30 is formed such that pressing members 32 are disposed at both widthwise ends of a sheet having a predetermined size (for example, a standard size, such as A3, A4, B4, B5, Legal, Letter, etc.) (see FIG. 3). In FIG. 3, if the sheet P is sized, for example, in A3 (portrait orientation), the pressing members 32 are disposed such that a pressing member 32 comes at each widthwise end of the sheet P (also see the bottom diagram of FIG. 5). As illustrated in the bottom diagram of FIG. 5, this arrangement enables the wave pattern to be formed such that the widthwise ends of the sheet P are oriented downward, in other words, in a direction away from the line head 10. This can reduce the likelihood of the widthwise ends of the sheet P coming into contact with the line head 10.

Note that the wave-pattern-forming section 30 may be disposed at the substantially same position in the medium transport direction as is the upstream-side transport section 20, as in Example 2, that will be described later. However, by disposing the wave-pattern-forming section 30 upstream of the upstream-side transport section 20 as in the embodiment, the sheet P on which the wave pattern is formed by the wave-pattern-forming section 30 can be reliably sent to the upstream-side transport section 20 and readily transported by the upstream-side transport section 20 with the wave pattern being maintained.

Support Rib

The support ribs 31 (second contact portion) that are included in the wave-pattern-forming section 30 will be described in detail below. Support ribs 31A each having an end shaped like a quadrangle in a cross section cut along the Z-X plane, as illustrated in FIG. 7, can be used as the support ribs 31. However, if the end of each support rib 31 is formed like the support rib 31A illustrated in FIG. 7, an individual first convex portion T of the wave pattern formed on the sheet P may be formed so as to swell between edges 35*a* of the end of the support rib 31. As a result, the level of the end of the support rib 31 may not align with the level z1 of the vertex of the first convex portion T. In this case, the level z1 of the vertex of the first convex portion T is expected to vary depending on the rigidity of a sheet (susceptibility to bending). This may lead to a difficulty in height alignment between the nipping portions 33 of the upstream-side transport roller pairs 40 and the vertexes of the first convex portions T formed by the wave-pattern-forming section 30.

In such a case, support ribs 31B each having an end shaped like an arc of a circle or an ellipse in a cross section cut along the Z-X plane, as illustrated in FIG. 8, can be preferably used as the support ribs 31. By employing the support ribs 31B, the level z1 of the vertex of an individual first convex portion T of the wave pattern formed on the sheet P can be made closer to the level of the end of each support rib 31B. Variation in the level z1 of the vertex of each first convex portion T caused by the rigidity of the sheet can be reduced.

Alternatively, support ribs 31C each having an end shaped like a polygon in a cross section cut along the Z-X plane, as illustrated in FIG. 9, can be used as the support ribs 31. Each support rib 31C is shaped like a polygon that has edges 35*b* between the edges 35*a*. The shape of the end of the support rib 31C is close to the arcuate end of the support rib 31B illustrated in FIG. 8. Compared with the support rib 31A illustrated in FIG. 7, the level z1 of the vertex of the first convex portion T of the wave pattern formed on the sheet P can be made closer to the level of the end of the support rib 31C.

Another Example of Support Rib

Support ribs 42 each having a structure illustrated in FIG. 10 can be used as the second contact portion that is included in the wave-pattern-forming section 30 in place of the support ribs 31 (31A to 31C) described above. Each support rib 42 includes a roller portion 44 that has a shaft 43 extending in the Y-axis direction, that is, in the medium transport direction. The shaft 43 is mounted on bearing portions 45*a*, 45*b*. The roller portion 44 is formed so as to be rotatable in either direction indicated by the double-pointed arrow E in FIG. 10. The roller portion 44 comes into contact with the second side of a sheet P. In forming the wave pattern on a sheet P, as described above, when the pressing members 32 press the sheet P downward and squeeze the sheet P between the pressing members 32 and the support ribs 31, the sheet P moves little by little in the width direction. The support ribs 42, which are equipped with the roller portions 44 that rotate when the sheet P moves in the width direction, can reduce resistance generated when the sheet P moves in the width direction in forming the wave pattern on the sheet P.

Pressing Member

Next, the pressing members 32 (first contact portions) that are included in the wave-pattern-forming section 30 will be described in detail. The wave-pattern-forming section 30 can be formed such that the pressing amount by which the pressing members 32 press the sheet P toward the support ribs 31 (i.e., reference D in FIG. 5) is adjustable. For example, the pressing members 32 may be disposed so as to be displaceable in a direction of proceeding to and withdrawing from the support ribs 31, and the end positions of the pressing members 32 may be formed displaceable with urging devices 46 (FIG. 11), such as springs. With this configuration, the pressing amount of the pressing members 32 can be changed. Note that the support ribs 31 are stationary.

The wave-pattern-forming section 30 (FIG. 11) is formed such that the pressing amount of the pressing members 32 is adjustable in a range from a small pressing amount D1 (in the top diagram of FIG. 11) to a large pressing amount D3 (in the middle diagram of FIG. 11). The pressing amount of the pressing members 32 can be changed by using a drive mechanism (not illustrated) (for example, a mechanism constituted by a motor and a rack and pinion) that is controlled by the control section 27. Since the pressing amount of the pressing members 32 is changeable in the wave-pattern-forming section 30, the height of the first convex portions T and the height of the second convex portions V can be adjusted in accordance with types of sheets that are different, for example, in rigidity or thickness.

Moreover, respective pressing amounts of the pressing members 32 may be changed individually. In this case, as illustrated in the bottom diagram in FIG. 11, the pressing amounts of pressing members 32 at the center in the width direction (X-axis direction) may be set larger than those of pressing members 32 at both ends. In the bottom diagram of FIG. 11, the pressing amounts of the pressing members 32 at both ends in the width direction are set at D1, while the pressing amounts of pressing members 32 next to the pressing members at both ends are set at D2. The pressing amounts of two pressing members 32 at the center are set at D3.

When a wave pattern is formed on a sheet P while the pressing members 32 and the support ribs 31 are set at the same pressing amount over the entire width (for example, bottom diagram of FIG. 5), the amount of power required for forming the wave pattern is greater at the center compared with that at an end because at the center, a larger area of the sheet P is affected by gathering the sheet P for forming the wave pattern. By setting the pressing amounts of the pressing members 32 at the center larger than those of the pressing members 32 at ends in the width direction (X-axis direction) (as in the bottom diagram of FIG. 11), the wave pattern at the center can be formed reliably.

Note that the wave-pattern-forming section is not limited to the wave-pattern-forming section 30 according to the present example in which both the first contact portions (pressing members 32) and the second contact portions (support ribs 31) are formed like ribs. The wave-pattern-forming section may be formed such that at least either the first contact portions or the second contact portions are replaced with rollers disposed in the width direction with spacing provided therebetween.

Another Example of Pressing Member

Pressing members 50 having a structure described below (FIGS. 12 and 13) can be used as the first contact portions that constitute the wave-pattern-forming section 30 in place of the pressing members 32. The pressing members 50 are formed such that the pressing amount by which the pressing members 50 press a sheet P toward the support ribs 31 (see the top diagram of FIG. 5) increases as the distance from the upstream ends of the pressing members 50 in the medium transport direction increases. More specifically, the pressing members 50 are formed such that the portions coming into contact with a sheet P decline (portions indicated by references 51, 56) from upstream ends to downstream ends (+Y-axis direction) in the medium transport direction. Note that although not illustrated in FIGS. 12 and 13, the support ribs 31 are provided below the pressing members 50 (−Z-axis direction). Of a plurality of the pressing members 50 disposed in the width direction (in FIG. 12), reference 50*a* denotes a pressing member at the center, reference 50*b* denotes each pressing member next to the pressing member 50*a* at the center, and reference 50*c* denotes each pressing member at the ends in the width direction.

In addition, each of the pressing members 50 has a first region 53 in which a sheet P is pressed toward the support ribs 31 in an upstream region of each pressing member 50 in the medium transport direction and a second region 54 in which the sheet P is pressed toward the support ribs 31 at a position downstream of the first region in the medium transport direction. A third region 55 is also disposed downstream of the second region 54 in the medium transport direction. A plurality of the pressing members 50 (50*c*, 50*b*, 50*a*, 50*b*, 50*c*) are provided in the width direction. The pressing amounts of the sheet P in the first region 53 are the same for all the pressing members 50, while in the second regions 54, the pressing amounts of the sheet P by the pressing members 50 at the center are larger than those by the pressing members 50 at the ends in the width direction.

More specifically, in the pressing members 50*c*, 50*b*, 50*a*, 50*b*, and 50*c*, respective first regions 53 are formed as inclined surfaces 56 having the same angle of inclination and the same length. Regarding the second regions 54, pressing members 50 located closer to the center have steeper inclined surfaces 51 (FIG. 13). Accordingly, when the pressing amounts in the second regions 54 are compared at a downstream end position 52*a* of an inclined surface 51*a* of the pressing member 50*a* at the center, the pressing amount of the pressing member 50*a* at the center in the width direction is the largest and the pressing amounts of the pressing members 50*b* located next to the pressing member 50*a* are the second largest. The pressing amounts of the pressing members 50*c* at both end in the width direction are the smallest. Similarly, when compared at downstream end positions 52*b* of inclined surfaces 51*b* of the pressing members 50*b*, the pressing amounts of the second regions 54 of three central pressing members 50*b*, 50*a*, 50*b* are large, while the pressing amounts of the pressing members 50*c* at the ends are the smallest. Note that all the pressing members 50 have the same pressing amount in the third regions 55, which are respective regions located downstream of the downstream end position 52*c* of the inclined surface 51*c* of the pressing member 50*c* at each end in the width direction.

The first regions 53, in which the pressing amounts of a sheet P pressed by the pressing members 50 are the same, can guide a sheet P being transported between the pressing members 50 and the support ribs (not illustrated in FIGS. 12 and 13). The second regions 54, in which the pressing amounts of a sheet P pressed by the pressing members 50 are larger at the center than at both ends, can form a wave pattern readily and smoothly.

Other Structures Around Wave-Pattern-Forming Section

Secondary Pressing Member

Secondary pressing members 60 will be described with reference to FIGS. 14 and 15. Secondary pressing members 60 are disposed upstream of the downstream-side transport roller pairs 41, which serve as the downstream-side transport section 21 (FIGS. 14 and 15). The secondary pressing members 60 are disposed, in the width direction (X-axis direction), at positions corresponding to the relieving spaces 39 in the downstream-side transport section 21 (FIG. 15). The secondary pressing members 60 can be formed similarly to the pressing members 32 that are included in the wave-pattern-forming section 30. The secondary pressing members 60 press the second convex portions V of a sheet P at positions upstream of the nipping portions 38 (which nip the first convex portions T) of the downstream-side transport roller pairs 41 in the downstream-side transport section 21, thereby reliably maintaining the wave pattern on the sheet P. If the secondary pressing members 60 are sufficiently close to the downstream-side transport roller pairs 41 in the Y-axis direction, the secondary pressing members 60 need not be disposed at positions corresponding to all of the relieving spaces 39 but may be disposed at positions corresponding to some of the relieving spaces 39.

Preliminary Transport Roller Pair

A preliminary transport roller pair 61 will be described with reference to FIG. 16. A preliminary transport roller pair 61 (FIG. 16) that transports a sheet P toward the wave-pattern-forming section 30 may be disposed upstream of the wave-pattern-forming section 30. The preliminary transport roller pair 61 is disposed downstream of a resist roller pair 19, which is not illustrated in FIG. 1. The preliminary transport roller pair 61 is formed so as to nip a portion of a sheet P in the width direction. In the embodiment, a single preliminary transport roller pair 61 is provided at both ends in the width direction.

If, for example, a single roller pair that transports a sheet P toward the wave-pattern-forming section 30 is formed so as to nip the entire width of the sheet P, the sheet P that reaches the wave-pattern-forming section 30 does not move flexibly in the width direction, which makes it difficult to form a wave pattern. In the embodiment, the preliminary transport roller pair 61 nips only a portion of a sheet P in the width direction, which provides the sheet P with a degree of freedom in widthwise movement when the sheet P has reached the wave-pattern-forming section 30. This enables the wave-pattern-forming section 30 to reliably form the wave pattern on the sheet P.

Preliminary Wave-Pattern-Forming Section

A preliminary wave-pattern-forming section 70 will be described below with reference to FIGS. 17 to 18. A preliminary wave-pattern-forming section 70 may be disposed upstream of the wave-pattern-forming section 30 in the medium transport direction (FIG. 17). The preliminary wave-pattern-forming section 70 forms, on a sheet P, a preliminary wave pattern that has first convex portions T1 (ridge portions T1) and second convex portions V1 (trough portions V1) which are smaller than those formed by the wave-pattern-forming section 30. Note that the first convex portions T and the first convex portions T1 protrude from the same side of a sheet P. Similarly, the second convex portions V and the second convex portions V1 protrude from the same side of the sheet P. As illustrated in FIG. 18, the preliminary wave-pattern-forming section 70, which has a structure similar to the wave-pattern-forming section 30, includes preliminary pressing members 72 that come in contact with the first side of a sheet P (a side facing the line head 10) and preliminary support ribs 71 that come in contact with the second side of the sheet P. The pressing amount of the preliminary pressing members 72 is set at D0 (FIG. 18), which is smaller than the pressing amount in the wave-pattern-forming section 30 (for example, pressing amount D in the top diagram of FIG. 5). This results in forming a preliminary wave pattern on the sheet P having the first convex portions T1 and the second convex portions V1 (a region indicated by reference numeral 74 in FIG. 17), which are smaller than those formed on the sheet P by the wave-pattern-forming section 30. By providing the preliminary wave-pattern-forming section 70 upstream of the wave-pattern-forming section 30, the preliminary wave-pattern-forming section 70 forms a smaller wave pattern and subsequently the wave-pattern-forming section 30 forms a more distinctive wave pattern. Thus, the wave pattern can be readily formed on a sheet P.

Example 2

Figure 19:
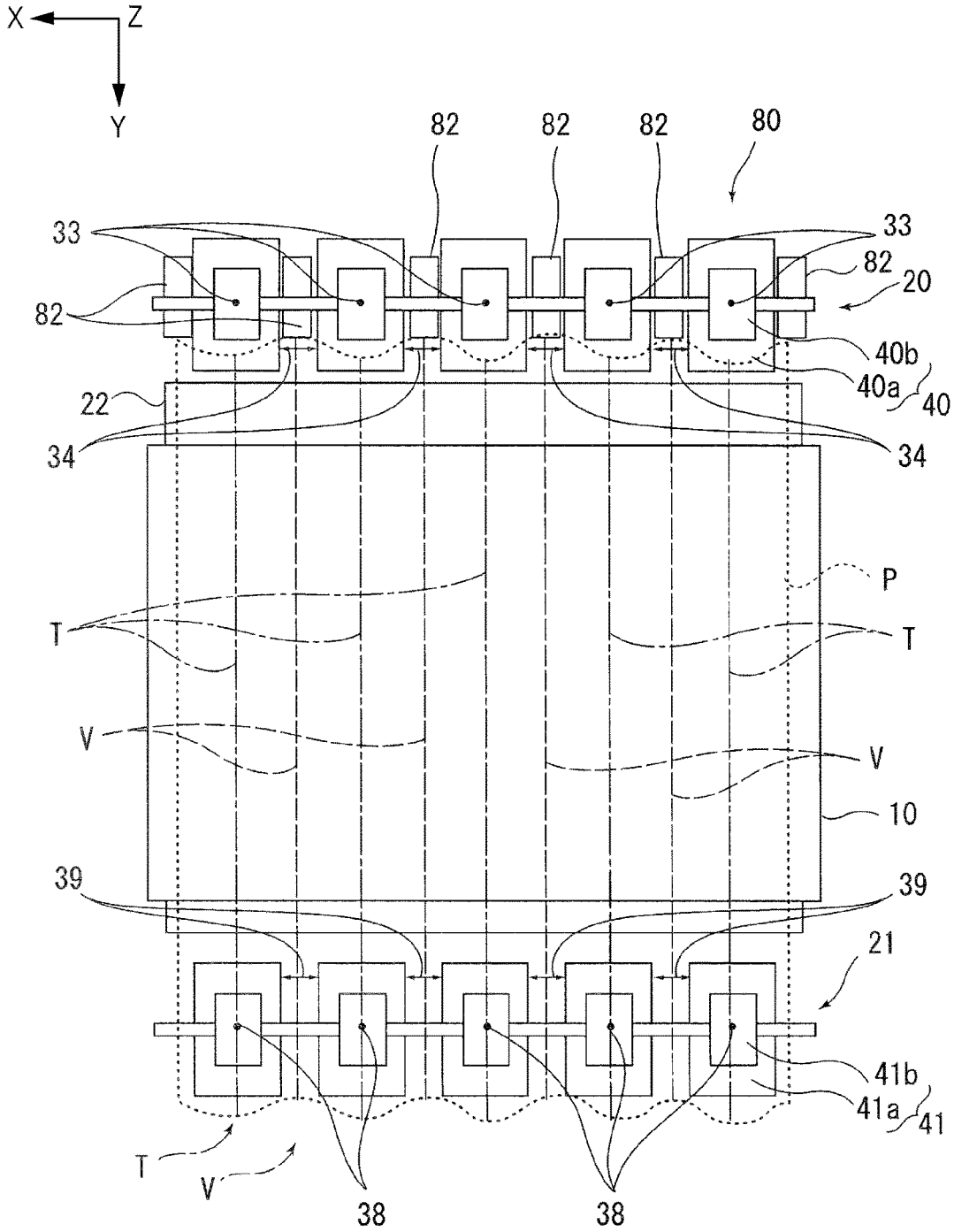
FIG. 19 is a plan view schematically illustrating a wave-pattern-forming section according to Example 2.
Figure 20:
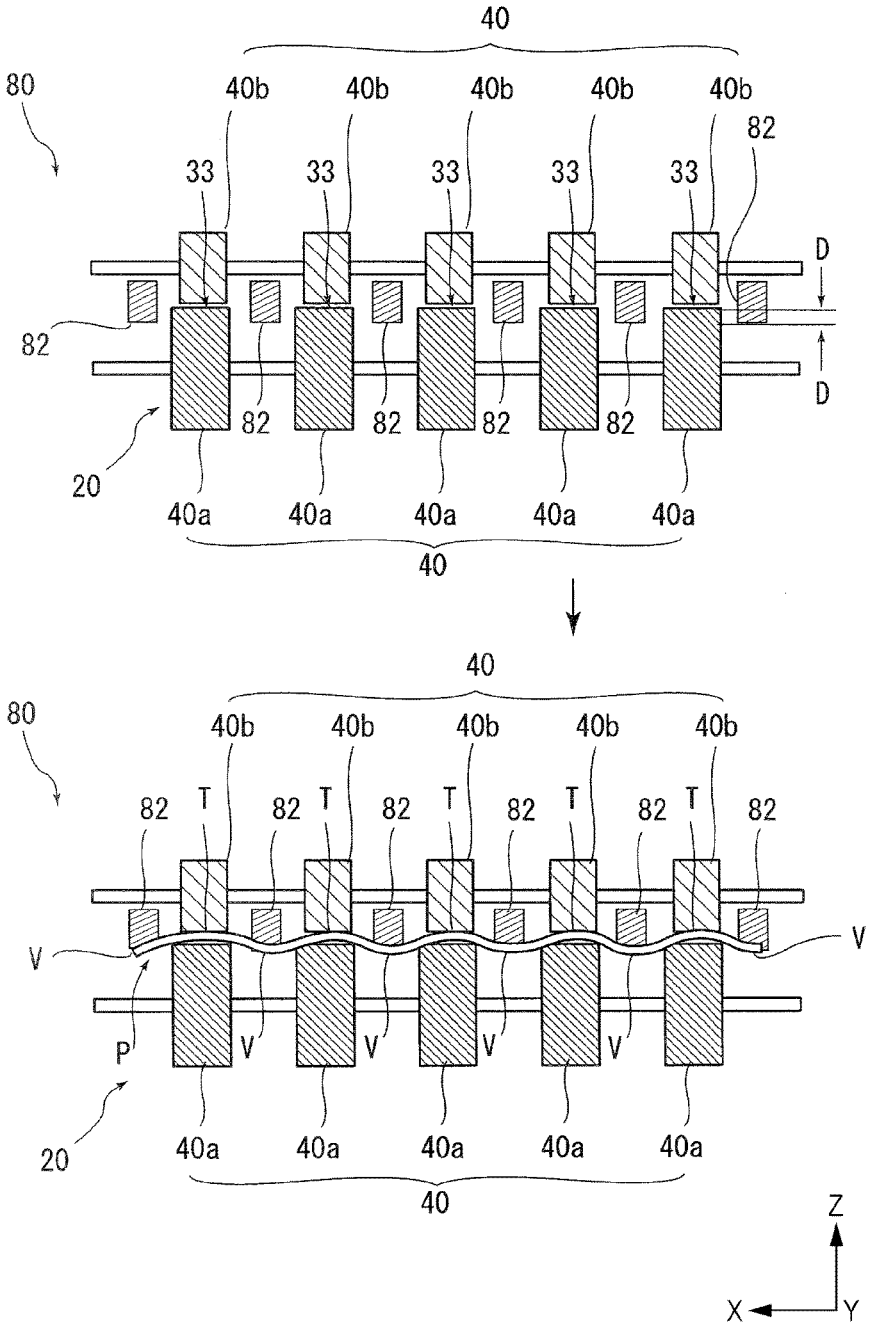
FIG. 20 is a cross-sectional view illustrating the wave-pattern-forming section according to Example 2, which is cut along the Z-X plane.

Another example of the wave-pattern-forming section will be described as Example 2 with reference to FIGS. 19 and 20. FIG. 19 is a plan view schematically illustrating a wave-pattern-forming section according to Example 2. FIG. 20 is a cross-sectional view illustrating the wave-pattern-forming section according to Example 2, which is cut along the Z-X plane. Note that in the present example, structures equivalent to those in Example 1 will be denoted by the same reference signs, thereby omitting duplicated explanation.

A wave-pattern-forming section 80 according to Example 2 is disposed, in the medium transport direction, at the same position at which the upstream-side transport section 20 (upstream-side transport roller pairs 40) is provided. The wave-pattern-forming section 80 includes pressing members 82, which serve as the first contact portions that come in contact with the first side of a sheet P that faces the line head 10 (FIG. 19). In the Example 2, the upstream-side transport roller pairs 40, which serve as the upstream-side transport section 20, play a role of the second contact portions that come in contact with the second side of the sheet P, which is a side opposite to the first side.

The pressing members 82 are disposed in the relieving spaces 34 that are provided between adjacent upstream-side transport roller pairs 40. In addition, the end portions of the pressing members 82 are positioned below the level of the nipping portions 33 of the upstream-side transport roller pairs 40 (in the top diagram of FIG. 20). Here, the distance between the nipping portions 33 and the end positions of the pressing members 82 is the pressing amount D of the wave-pattern-forming section 80. The wave pattern can be formed on a sheet P by the wave-pattern-forming section 80 that is formed as described above when the sheet P is nipped and transported by the upstream-side transport roller pairs 40. In this embodiment, the wave-pattern-forming section 80 can be disposed in a space-efficient manner, and thus, the size of a recording apparatus can be reduced.

Note that the disclosure is not limited to the examples described above and various modifications can be made within the scope of the disclosure set forth in the claims. Thus, all such modifications are intended to be included within the scope of this disclosure.

The entire disclosure of Japanese Patent Application No.: 2017-108311, filed on May 31, 2017 is expressly incorporated by reference herein.

What is claimed is:

1. A recording apparatus, comprising:

a recording section that performs recording by ejecting liquid onto a medium being transported;

an upstream-side transport section that is disposed upstream of the recording section in a medium transport direction;

a downstream-side transport section that is disposed downstream of the recording section in the medium transport direction; and a forming section that is disposed upstream of the upstream-side transport section in the medium transport direction and that forms first convex portions protruding from one side of the medium and extending in the medium transport direction and second convex portions protruding from the other side of the medium and extending in the medium transport direction, the first convex portions and the second convex portions being formed alternately on the medium in a width direction that intersects the medium transport direction, wherein the upstream-side transport section includes transport roller pairs that are disposed in the width direction and that nip and transport the medium, and the transport roller pairs nip either the first convex portions or the second convex portions that are formed on the medium.

2. The recording apparatus according to claim 1, wherein the transport roller pairs nip the first convex portions formed on the medium.

3. The recording apparatus according to claim 2, wherein a position of each of the transport roller pairs is in alignment with a position of a vertex of each of the first convex portions of the medium in a normal direction normal to the vertex of each of the first convex portions.

4. The recording apparatus according to claim 3, wherein the forming section includes first contact portions that come into contact with a first side of the medium that faces the recording section and second contact portions that come into contact with a second side of the medium that is opposite to the first side, the first contact portions and the second contact portions are disposed alternately in the width direction with spacing therebetween, and respective end portions of the first contact portions and respective end portions of the second contact portions partially overlap each other in the normal direction when viewed in the width direction.

5. The recording apparatus according to claim 4, wherein the forming section is formed such that one of the first contact portions is disposed at each end of the medium having a predetermined size in the width direction.

6. The recording apparatus according to claim 4, wherein the forming section is formed such that pressing amounts of the first contact portions that press the medium toward the second contact portions are changeable.

7. The recording apparatus according to claim 4, wherein the pressing amounts of the first contact portions that press the medium toward the second contact portions increase as a distance from upstream ends of the first contact portions in the medium transport direction increases.

8. The recording apparatus according to claim 7, wherein the first contact portions have respective first regions and respective second regions located downstream of the first regions in the medium transport direction and the first regions and the second regions are regions in which the first contact portions press the medium toward the second contact portions, the pressing amounts for pressing the medium in the first regions of the first contact portions that are disposed in the width direction are the same, the pressing amounts for pressing the medium in the second regions of the first contact portions located at a center in the width direction are larger than those in the second regions of the first contact portions located at ends in the width direction.

9. The recording apparatus according to claim 4, wherein the pressing amounts of the first contact portions that press the medium toward the second contact portions are such that the pressing amounts of the first contact portions located at a center in the width direction are larger than those of the first contact portions located at ends in the width direction.

10. The recording apparatus according to claim 1, further comprising a preliminary transport roller pair that transports the medium toward the forming section, wherein the preliminary transport roller pair nips a portion of the medium in the width direction.

11. The recording apparatus according to claim 1, further comprising a preliminary forming section that is disposed upstream of the forming section in the medium transport direction and that forms first small convex portions and second small convex portions on the medium, wherein the first small convex portions are smaller than the first convex portions and the second small convex portions are smaller than the second convex portions, the first convex portions and the second convex portions being formed on the medium by the forming section.

12. The recording apparatus according to claim 1, wherein the downstream-side transport section includes discharge roller pairs that are disposed in the width direction and that nip and transport the medium, and, of the first convex portions and the second convex portions that are formed on the medium, the discharge roller pairs nip the first or second convex portions that have been nipped by the transport roller pairs.

13. A recording apparatus, comprising:

a recording section that performs recording by ejecting liquid onto a medium being transported;

an upstream-side transport section that is disposed upstream of the recording section in a medium transport direction;

a downstream-side transport section that is disposed downstream of the recording section in the medium transport direction; and a forming section that forms first convex portions protruding from one side of the medium and extending in the medium transport direction and second convex portions protruding from the other side of the medium and extending in the medium transport direction, the first convex portions and the second convex portions being formed alternately on the medium in a width direction that intersects the medium transport direction, wherein the upstream-side transport section includes transport roller pairs that are disposed in the width direction and that nip and transport the medium, and the transport roller pairs nip either the first convex portions or the second convex portions that are formed on the medium.

* * * * *